US006409094B2

(12) United States Patent
Tojo et al.

(10) Patent No.: US 6,409,094 B2
(45) Date of Patent: Jun. 25, 2002

(54) STRUCTURE OF FUEL INJECTOR ADJUSTABLE IN FUEL JET CHARACTERISTIC

(75) Inventors: Senta Tojo; Tetsuya Toyao, both of Kariya; Teruaki Yamaguchi, Anjo; Motoichi Murakami, Susono, all of (JP)

(73) Assignees: Denso Corporation, Kariya; Toyota Jidosha Kabushiki Kaisha, Toyota, both of (JP)

( * ) Notice: Subject to any disclaimer, the term of this patent is extended or adjusted under 35 U.S.C. 154(b) by 0 days.

(21) Appl. No.: 09/801,817

(22) Filed: Mar. 9, 2001

(30) Foreign Application Priority Data

Mar. 13, 2000 (JP) ..... 2000-068754

(51) Int. Cl.[7] ..... F02D 1/06

(52) U.S. Cl. ..... 239/5; 239/88; 239/96; 239/533.5; 239/533.6; 239/533.8; 239/580; 239/585.1

(58) Field of Search ..... 239/5, 88, 96, 239/533.3, 533.4, 533.5, 533.6, 533.8, 580, 585.1

(56) References Cited

U.S. PATENT DOCUMENTS 4,346,847 A 8/1982 Rissi
4,498,625 A * 2/1985 Schechter ..... 239/5
5,157,967 A 10/1992 Wieczorek
5,383,606 A * 1/1995 Stegmaier et al. ..... 239/580
5,449,119 A * 9/1995 Maley ..... 239/88
5,873,526 A * 2/1999 Cooke ..... 239/96

FOREIGN PATENT DOCUMENTS

| | | |
|---|---|---|
| JP | 57-13267 | 1/1982 |
| JP | 57-51944 | 3/1982 |
| JP | 7-504008 | 4/1995 |
| JP | 2599281 | 1/1997 |

* cited by examiner

*Primary Examiner*—Steven J. Ganey
(74) *Attorney, Agent, or Firm*—Nixon & Vanderhye PC

(57) ABSTRACT

A fuel injector is provided which has an improved structure capable of adjusting fuel jet characteristics such as the quantity of fuel to be injected to an engine and a fuel injection time lag after the fuel injector is assembled. The fuel injector includes an air gap adjusting screw and a spring pressure adjusting screw. The air gap adjusting screw serves to change an air gap between a stator and an armature of a solenoid valve to adjust the quantity of fuel to a target one. The spring pressure adjusting screw serves to change a spring pressure urging a valve in a spray hole-closing direction to regulate a spray hole open duration, thereby adjusting the fuel injection time lag or the quantity of fuel.

29 Claims, 8 Drawing Sheets

STRUCTURE OF FUEL INJECTOR ADJUSTABLE IN FUEL JET CHARACTERISTIC

BACKGROUND OF THE INVENTION

1. Technical Field of the Invention

The present invention relates generally to an improved structure of a fuel injector capable of adjusting fuel jet characteristics such as the quantity of a fuel jetting out of the fuel injector and fuel injection time lag after assembled.

2. Background Art

Fuel injectors are known in the art which are designed to control the fuel pressure in a pressure chamber formed in a nozzle body which acts on a valve for closing an injection nozzle. For moving the valve, the fuel injector controls a balance of a valve-opening pressure developed by the fuel pressure supplied to a fuel sump, a valve-closing pressure developed by the fuel pressure in the pressure chamber, and a spring pressure acting on the valve to close the nozzle. Within the pressure chamber, a fuel drain valve is installed. The regulation of the fuel pressure in the pressure chamber is accomplished by opening and closing the fuel drain valve.

Japanese Patent No. 2599281 discloses such a fuel injector which is illustrated in FIG. 8.

A constant pressure of fuel is supplied to a pressure control chamber 211 and a fuel sump 216. A valve hole 207 leading to the pressure chamber 211 is closed by a control valve 206. When the sum of the fuel pressure in the control pressure chamber 211 working to urge the control valve 206 in a valve-opening direction and the attractive force produced by an electromagnet 213 attracting an armature 205 overcomes the spring pressure of a coil spring 203 urging the control valve 206 in a valve-closing direction, it will cause the control valve 206 to be lifted up to open the valve hole 207, so that the fuel pressure in the control pressure chamber 211 drains to a magnet chamber 215 through a valve chamber 217 and holes formed in a yoke 212, thereby resulting in a drop in fuel pressure within the control pressure chamber 211. This causes the sum of fuel pressure in the fuel sump 216 urging a nozzle valve 200 in a spray hole-opening direction and the pressure produced by a coil spring 218 urging the nozzle valve 200 in a spray hole-closing direction to overcome the fuel pressure in the control pressure chamber 211, thereby lifting the nozzle valve 200 upward. When the electromagnet 213 is deenergized, it will cause the control valve 206 to close the valve hole 207, thereby resulting in an increase in fuel pressure within the control pressure chamber 211. This causes the nozzle valve 200 to be moved downward to close the spray hole. The injection timing, therefore, has a correlation with the time of lift of the control valve 206. The quantity of fuel injected has a correlation with the length of time the valve hole 207 is opened.

The above fuel injector, however, has a problem that it is difficult to adjust the quantity of fuel injected after the fuel injector is assembled. The reason for this will be discussed below.

The lift of the control valve 206 undergoes a time lag between application of a drive pulse signal to the electromagnet 213 and action of a valve-lifting force on the control valve 206. The injection delay depends upon the spring load produced by the spring 203 on the control valve 206 in the valve-closing direction. The spring load is determined by the degree to which an adjusting screw 202 is fastened. It is, however, impossible to change the fastening degree of the adjusting screw 202 after the fuel injector is assembled, thus resulting in a difficulty in adjusting the time lag and the action of the valve-lifting force on the control valve 206.

If the width of the drive pulse signal applied to the electromagnet 213 is constant, and the fuel pressure supplied to the fuel injector is also constant, the opening duration of the valve hole 207 depends upon a time delay between rising of the drive pulse signal and the time the control valve starts to be lifted and a time delay between falling of the drive pulse signal and the time the control valve closes the valve hole 207. The valve lift time delay depends upon the spring load of the spring 203 and, thus, impossible to regulate after the fuel injector is assembled. The valve closing time delay depends upon the amount of lift of the control valve 206 and the spring load of the spring 203. A maximum amount of lift of the control valve 206 is determined by an air gap between the stator or yoke 204 and the armature 205. It is, however, impossible to adjust the spring load for the same reason as described above. The electromagnet 213 and the valve hole 207 are both restrained by a guide member 208 from moving. The guide member 208 is held between a nozzle body 209 and a control body 214. The air gap between the yoke 204 and the armature 205 is a function of the distance between the valve hole 207 and the yoke 204. It is, thus, impossible to change the amount of lift of the control valve 206 after the fuel injector is assembled. For these reasons, the opening duration of the valve hole 207 cannot be adjusted after the assembly of the fuel injector, thus resulting in a difficulty in regulating the quantity of fuel to be injected into the engine.

Accordingly, the regulation of the quantity of fuel injected should be accomplished by repeating a series of operations: inspection of the quantity of fuel injected, disassembly of the fuel injector, turning of the adjusting screw 202, and/or replacement of the guide member 208. This, however, results in a great reduction in productivity. It is also impossible to eliminate a difference in quantity of fuel injected between fuel injectors arising from a difference in size between spray holes.

Further, it is impossible to drain the fuel in the control pressure chamber 211 from a drain passage 201 along a longitudinal center line of the fuel injector. The fuel is, in practice, discharged to the drain passage 201 from the valve hole 207 through the magnet chamber 215 surrounding the electromagnet 213, thus resulting in an increase in size of the fuel injector in a widthwise-direction thereof.

SUMMARY OF THE INVENTION

It is therefore a principal object of the invention to avoid the disadvantages of the prior art.

It is another object of the invention to provide a compact structure of a fuel injector which is capable of adjusting a fuel jet characteristic such as the quantity of a fuel jet to a target one after the fuel injector is assembled.

According to one aspect of the invention, there is provided an improved structure of a fuel injector capable of adjusting a fuel jet characteristic after assembled. The fuel injector comprises: (a) a nozzle having formed therein a spray hole from which fuel is sprayed; (b) a nozzle valve selectively opening and closing the spray hole; (c) an injector body supporting therein the nozzle valve slidably, the injector body having formed therein a fuel sump supplied with the fuel from an inlet formed in the injector body to produce fuel pressure urging the nozzle valve in a spray hole-opening direction, a pressure chamber supplied with the fuel from the inlet to produce fuel pressure urging the nozzle valve in a spray hole-closing direction, and a valve hole establishing fluid communication between the pressure chamber and a drain port formed in the injector body; (d) a control valve selectively opening and closing the valve hole formed in the injector body; (e) a first urging mechanism urging the control valve in a valve hole-closing direction for closing the valve hole to block the fluid communication between the pressure chamber and the drain port; (f) a control valve moving mechanism made up of a stationary portion and a movable portion, the stationary portion including a stator and a coil, the movable portion including an armature which is connected fixedly to the control valve and spaced from the stator through a given air gap, the coil being energized electrically to produce an attractive force through the stator for attracting the armature to move the control valve in a valve hole-opening direction, thereby opening the valve hole to establish the fluid communication between the pressure chamber and the drain port; (g) a second urging mechanism urging the stationary portion of the control valve moving mechanism in a first direction identical with the valve hole-opening direction; and (h) an air gap adjusting member disposed around the stationary portion of the control valve moving mechanism in engagement with the injector body so as to urge the stationary portion of the control valve moving mechanism in a second direction opposite the first direction against an urging pressure produced by the second urging mechanism to keep the air gap between the stator and the armature, the air gap adjusting member being designed to be movable selectively in the first direction and second direction for changing the air gap.

In the preferred mode of the invention, the air gap adjusting mechanism is connected to the injector body in a screw fashion. For example, the air gap adjusting mechanism has formed therein an internal thread engaging an outer thread formed on an end portion of the injector body and forms a sliding pair with the control pair moving mechanism.

The air gap adjusting mechanism is made of a hollow member fitted on the injector body.

The second urging mechanism is implemented by a disc spring disposed within the injector body.

According to the second aspect of the invention, there is provided an improved structure of a fuel injector capable of adjusting a fuel jet characteristic after assembled. The fuel injector comprises: (a) a nozzle having formed therein a spray hole from which fuel is sprayed; (b) a nozzle valve selectively opening and closing the spray hole; (c) an injector body supporting therein the nozzle valve slidably, the injector body having formed therein a fuel sump supplied with the fuel from an inlet formed in the injector body to produce fuel pressure urging the nozzle valve in a spray hole-opening direction, a pressure chamber supplied with the fuel from the inlet to produce fuel pressure urging the nozzle valve in a spray hole-closing direction, and a valve hole for establishing fluid communication between the pressure chamber and a drain port formed in the injector body; (d) a valve chamber formed in the injector body downstream of the valve hole; (e) a control valve movable within the valve chamber to selectively open and close the valve hole formed in the injector body, when leaving the valve hole, the control valve defining in the valve chamber a first drain passage communicating with the pressure chamber through the valve hole; (f) an urging mechanism disposed within an urging mechanism mount chamber formed in the injector body leading to the first drain passage, the urging mechanism working to produce an urging pressure which urges the control valve in a valve hole-closing direction for closing the valve hole to block the fluid communication between the pressure chamber and the valve chamber; (g) a control valve moving mechanism made up of a stationary portion and a movable portion, the stationary portion including a stator and a coil, the movable portion including an armature which is connected fixedly to the control valve, the coil being energized electrically to produce an attractive force through the stator for attracting the armature to move the control valve in a valve hole-opening direction against the urging pressure produced by the urging mechanism, thereby opening the valve hole to establish the fluid communication between the pressure chamber and the first drain passage; and (h) an urging pressure adjusting mechanism disposed within the injector body in contact with the urging mechanism, the urging pressure adjusting mechanism being so designed as to be movable in engagement with an inner wall of the urging mechanism mount chamber for changing the urging pressure produced by the urging mechanism, the urging pressure adjusting mechanism having formed therein a second drain passage communicating between the first drain passage and the drain port through the urging mechanism mount chamber.

In the preferred mode of the invention, the urging pressure adjusting mechanism engages the inner wall of the urging mechanism mount chamber in a screw fashion.

The urging pressure adjusting mechanism may alternatively be press-fitted within the urging mechanism mount chamber.

The fuel injector further comprises a second urging mechanism which urges the stationary portion of the control valve moving mechanism in a first direction identical with the valve hole-opening direction and an air gap adjusting member disposed around the stationary portion of the control valve moving mechanism in engagement with the injector body so as to urge the stationary portion of the control valve moving mechanism in a second direction opposite the first direction against an urging pressure produced by the second urging mechanism to keep an air gap between the stator and the armature. The air gap adjusting member is designed to be movable selectively in the first direction and second direction for changing the air gap.

The air gap adjusting mechanism is connected to the injector body in a screw fashion.

The air gap adjusting mechanism has formed therein an internal thread engaging an outer thread formed on an end portion of the injector body and forms a sliding pair with the control pair moving mechanism.

The air gap adjusting mechanism is made of a hollow member fitted on the injector body.

The second urging mechanism is implemented by a disc spring disposed within the injector body.

According to the third aspect of the invention, there is provided a method of adjusting a fuel injection characteristic of a fuel injector which is designed to inject fuel into an engine and which includes: (a) a nozzle having formed therein a spray hole from which fuel is sprayed; (b) a nozzle valve selectively opening and closing the spray hole; (c) an injector body supporting therein the nozzle valve slidably, the injector body having formed therein a fuel sump supplied with the fuel from an inlet formed in the injector body to produce fuel pressure urging the nozzle valve in a spray hole-opening direction, a pressure chamber supplied with the fuel from the inlet to produce fuel pressure urging the nozzle valve in a spray hole-closing direction, and a valve hole establishing fluid communication between the pressure chamber and a drain port formed in the injector body; (d) a control valve selectively opening and closing the valve hole formed in the injector body; and (e) a control valve moving mechanism made up of a stationary portion and a movable portion, the stationary portion including a stator and a coil wound around the stator, the movable portion including an armature which is connected fixedly to the control valve and spaced from the stator through a given air gap, the coil being energized electrically to produce an attractive force through the stator for attracting the armature to move the control valve in a valve hole-opening direction, thereby opening the valve hole to establish the fluid communication between the pressure chamber and the drain port so that the fuel pressure in the pressure chamber is decreased to move the nozzle valve so as to open the spray hole. The method comprises the steps of: (a) supplying a test liquid to the fuel injector from the inlet at a given pressure level higher than half a maximum pressure of the fuel which is supplied to the fuel sump and the pressure chamber when the fuel injector is actually used to inject the fuel into the engine; (b) applying a drive pulse signal to the coil of the control valve moving mechanism to energize the coil for spraying the test liquid from the spray hole; and (c) changing the air gap between the stator and the armature to adjust a quantity of the test liquid sprayed from the spray hole to a target one.

The fuel injector further comprises: (a) a first urging mechanism urging the control valve in a valve hole-closing direction for closing the valve hole to block the fluid communication between the pressure chamber and the drain port; (b) a second urging mechanism urging the stationary portion of the control valve moving mechanism in a first direction identical with the valve hole-opening direction, and (c) an air gap adjusting member disposed around the stationary portion of the control valve moving mechanism in engagement with the injector body so as to urge the stationary portion of the control valve moving mechanism in a second direction opposite the first direction against an urging pressure produced by the second urging mechanism to keep the air gap between the stator and the armature. The air gap adjusting member is designed to be movable selectively in the first direction and second direction for changing the air gap. The air gap changing step moves the air gap adjusting mechanism to change the air gap between the stator and the armature to adjust the quantity of the test liquid sprayed from the spray hole to the target one.

The drive pulse applying step applies a first drive pulse signal and a second drive pulse signal having a width different from that of the first drive pulse signal in sequence to the coil of the control valve moving mechanism to energize the coil during the air gap changing step.

The width of the first drive pulse signal is longer than that required to move the nozzle valve until a maximum rate of a jet of the test liquid from the spray hole is reached.

If target quantities of the test liquid sprayed from the spray hole when the first and second drive pulse signals are applied to the coil of the control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\delta 2$, the air gap changing step changes the air gap so as to meet at least one of a condition of $\delta 1^2+\delta 2^2 \leqq K1$ and a condition of $\delta 1 \times \delta 2<0$, $\delta 1 \leqq K2$, and $\delta 2 \leqq K3$ where K1, K2, and K3 are preselected target values, (e.g., 1 $mm^3$/st, 0.5 $mm^3$/st, and 1 $mm^3$/st), respectively.

According to the fourth aspect of the invention, there is provided a method of adjusting a fuel injection characteristic of a fuel injector which is designed to inject fuel into an engine and which includes: (a) a nozzle having formed therein a spray hole from which fuel is sprayed; (b) a nozzle valve selectively opening and closing the spray hole; (c) an injector body supporting therein the nozzle valve slidably, the injector body having formed therein a fuel sump supplied with the fuel from an inlet formed in the injector body to produce fuel pressure urging the nozzle valve in a spray hole-opening direction, a pressure chamber supplied with the fuel from the inlet to produce fuel pressure urging the nozzle valve in a spray hole-closing direction, and a valve hole establishing fluid communication between the pressure chamber and a drain port formed in the injector body; (d) a control valve selectively opening and closing the valve hole formed in the injector body; (e) an urging mechanism disposed within an urging mechanism mount chamber formed in the injector body, the urging mechanism working to produce an urging pressure which urges the control valve in a valve hole-closing direction for closing the valve hole to block the fluid communication between the pressure chamber and the drain port; and (f) a control valve moving mechanism made up of a stationary portion and a movable portion, the stationary portion including a stator and a coil wound around the stator, the movable portion including an armature which is connected fixedly to the control valve, the coil being energized electrically to produce an attractive force through the stator for attracting the armature to move the control valve in a valve hole-opening direction, thereby opening the valve hole to establish the fluid communication between the pressure chamber and the drain port so that the fuel pressure in the pressure chamber is decreased to move the nozzle valve so as to open the spray hole. The method comprises the steps of: (a) supplying a test liquid to the fuel injector from the inlet at a given pressure level higher than half a maximum pressure of the fuel which is supplied to the pressure chamber when the fuel injector is actually used to inject the fuel into the engine; (b) applying a drive pulse signal to the coil of the control valve moving mechanism to energize the coil for spraying the test liquid from the spray hole; and (c) changing the urging pressure produced by the urging mechanism to adjust a quantity of the test liquid sprayed from the spray hole to a target one.

The fuel injector further comprises an urging pressure adjusting mechanism disposed within the injector body in contact with the urging mechanism. The urging pressure adjusting mechanism is so designed as to be movable in engagement with an inner wall of the urging mechanism mount chamber for changing the urging pressure produced by the urging mechanism. The urging pressure adjusting mechanism has formed therein a second drain passage communicating between a first drain passage communicating with the pressure chamber through the valve hole and the drain port through the urging mechanism mount chamber. The urging pressure changing step moves the urging pressure adjusting mechanism to shift the urging mechanism for adjusting the quantity of the test liquid sprayed from the spray hole to the target one.

The drive pulse applying step applies a first drive pulse signal and a second drive pulse signal having a width different from that of the first drive pulse signal in sequence to the coil of the control valve moving mechanism to energize the coil during the air gap changing step.

The width of the first drive pulse signal is longer than that required to move the nozzle valve until a maximum rate of a jet of the test liquid from the spray hole is reached.

If target quantities of the test liquid sprayed from the spray hole when the first and second drive pulse signals are applied to the coil of the control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\delta 2$, the air gap changing step changes the air gap so as to meet at least one of a condition of $\delta 1^2+\delta 2^2 \leqq K1$ and a condition of $\delta 1 \times \delta 2<0$, $\delta 1 \leqq K2$, and $\delta 2 \leqq K3$ where K1, K2, and K3 are preselected target values, respectively.

According to the fifth aspect of the invention, there is provided a method of adjusting a fuel injection characteristic of a fuel injector which is designed to inject fuel into an engine and which includes: (a) nozzle having formed therein a spray hole from which fuel is sprayed; (b) a nozzle valve selectively opening and closing the spray hole; (c) an injector body supporting therein the nozzle valve slidably, the injector body having formed therein a fuel sump supplied with the fuel from an inlet formed in the injector body to produce fuel pressure urging the nozzle valve in a spray hole-opening direction, a pressure chamber supplied with the fuel from the inlet to produce fuel pressure urging the nozzle valve in a spray hole-closing direction, and a valve hole establishing fluid communication between the pressure chamber and a drain port formed in the injector body; (d) a control valve selectively opening and closing the valve hole formed in the injector body; (e) an urging mechanism disposed within an urging mechanism mount chamber formed in the injector body, the urging mechanism working to produce an urging pressure which urges the control valve in a valve hole-closing direction for closing the valve hole to block the fluid communication between the pressure chamber and the drain port; and (f) a control valve moving mechanism made up of a stationary portion and a movable portion, the stationary portion including a stator and a coil wound around the stator, the movable portion including an armature which is connected fixedly to the control valve and spaced from the stator through an air gap, the coil being energized electrically to produce an attractive force through the stator for attracting the armature to move the control valve in a valve hole-opening direction, thereby opening the valve hole to establish the fluid communication between the pressure chamber and the drain port so that the fuel pressure in the pressure chamber is decreased to move the nozzle valve so as to open the spray hole. The method comprises: (a) a first step of changing the urging pressure produced by the urging mechanism while supplying a test liquid to the fuel injector from the inlet and applying a drive pulse signal to the coil of the control valve moving mechanism to energize the coil for spraying the test liquid from the spray hole so as to have an injection lag time fall in a target range and (b) a second step of changing the air gap between the stator and the armature while supplying a test liquid to the fuel injector from the inlet and applying a drive pulse signal to the coil of the control valve moving mechanism to energize the coil for spraying the test liquid from the spray hole so as to have a quantity of the test liquid sprayed from the spray hole fall in a target range.

In the preferred mode of the invention, the test liquid is supplied at a given pressure level lower than half a maximum pressure of the fuel which is supplied to the pressure chamber when the fuel injector is actually used to inject the fuel into the engine in each of the first and second steps.

The test liquid may alternatively be supplied at a given pressure level higher than half a maximum pressure of the fuel which is supplied to the pressure chamber when the fuel injector is actually used to inject the fuel into the engine in each of the steps.

Each of the first and second steps applies first and second drive pulse signal having different widths alternately to the coil of the control valve moving mechanism.

In the second step, at least one of the first and second drive pulse signals has the width greater than a width required for moving the nozzle valve up to a level where a maximum rate of spraying of the test liquid from the spray hole is reached.

If target quantities of the test liquid sprayed from the spray hole when the first and second drive pulse signals are applied to the coil of the control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\delta 2$, the air gap changing step changes the air gap so as to meet at least one of a condition of $\delta 1^2+\delta 2^2 \leqq K1$ and a condition of $\delta 1 \times \delta 2<0$, $\delta 1 \leqq K2$, and $\delta 2 \leqq K3$ where K1, K2, and K3 are preselected target values, respectively.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
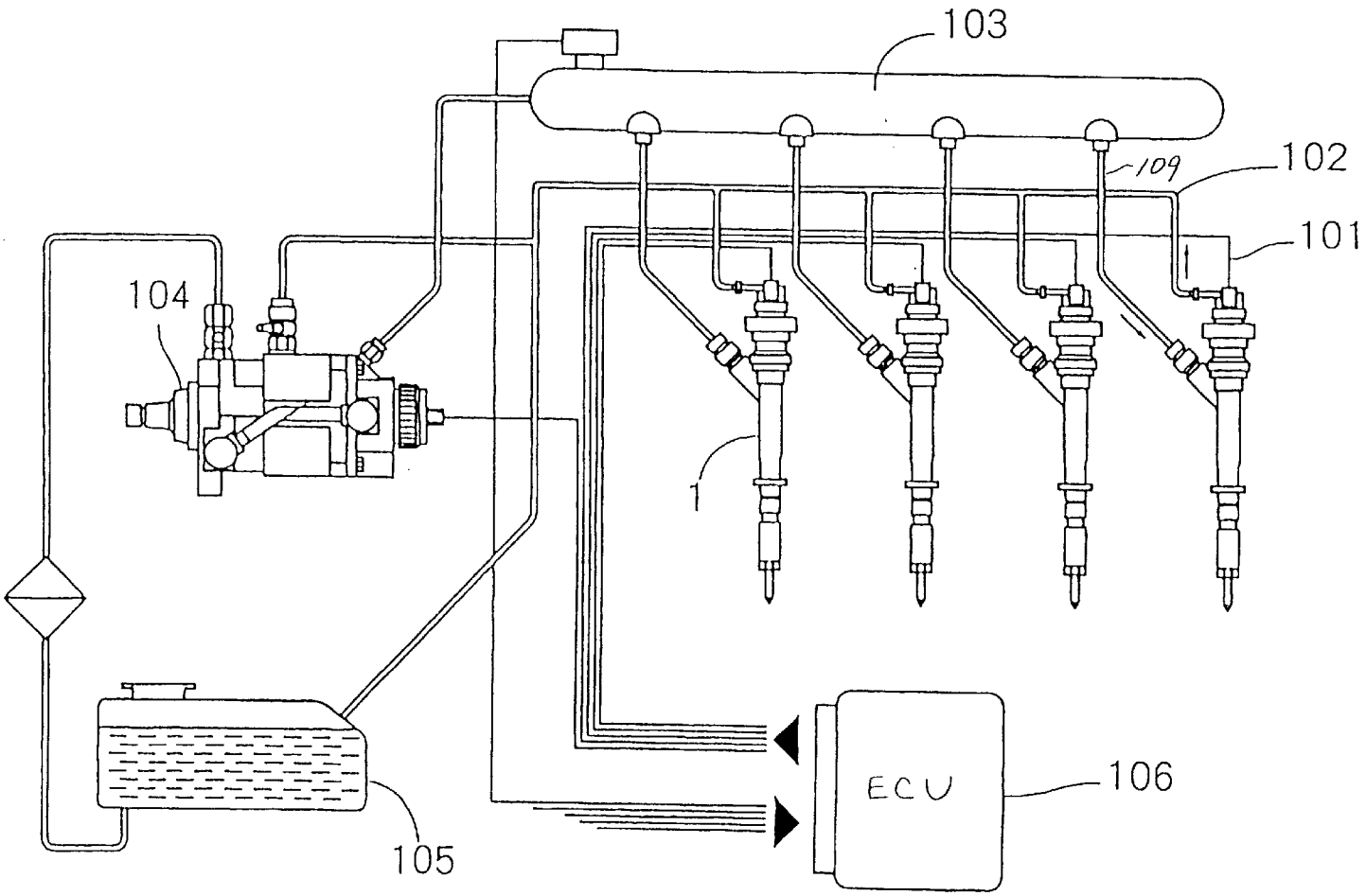
FIG. 1 is a view which shows a fuel injection system for diesel engines in which fuel injectors of the invention are used.

Referring to the drawings, wherein like reference numbers refer to like parts in several views, particularly to FIG. 1, there are shown fuel injectors 1 according to the present invention.

The fuel injectors 1 are installed in a head of an internal combustion engine (not shown) and inject fuel directly into cylinders of the engine, respectively. A fuel injection pump 104 sucks fuel from a fuel tank 105, pressurizes and supplies it to a chamber in an accumulator pipe 103 in which the fuel is held at a given pressure level. The fuel in the accumulator pipe 103 is supplied to each of the fuel injectors 1 through a supply pipe 109. The fuel injection pump 104 adjusts a delivery pressure of fuel as functions of the speed and load of the engine, the pressure of fuel sucked thereinto, the quantity of intake air, and the temperature of cooling water. The fuel injectors 1 and the fuel injection pump 104 are controlled by an electronic control unit (ECU) 106.

Figure 2:
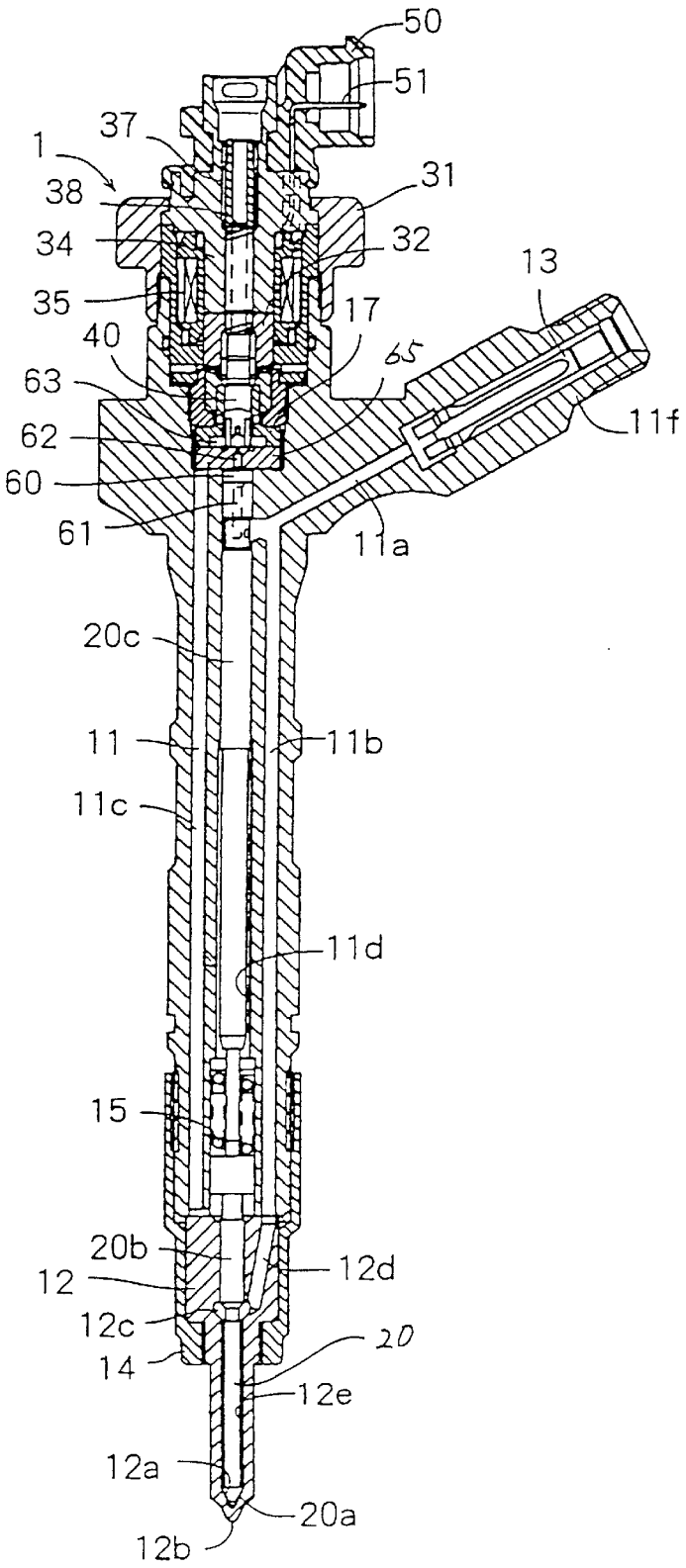
FIG. 2 is a vertical sectional view which shows the structure of a fuel injector according to the invention.

Each of the fuel injectors 1, as shown in FIG. 2, includes a housing 11 (i.e., an injector body) and a nozzle body 12 which are joined by a retaining nut 14. The housing 11 has formed therein a needle chamber 11*d*, a fuel inlet passage 11*a*, a fuel passage 11*b*, and a leak passage 11*c*. The leak passage 11*c* communicates with the needle chamber 11*d*. To the fuel inlet passage 11*a*, a high-pressure fuel is supplied through a bar filter 13 installed in a connector 11*f*. The nozzle body 12 has formed therein a fuel passage 12*d*, a fuel sump 12*c*, a needle chamber 12*e*, and a spray hole 12*b* which communicate with each other. A valve seat 12*a* is formed on an inner wall of a spray tip of the nozzle body 12. The fuel passage 12*d* leads to the fuel passage 11*b*.

The fuel injector 1 also includes a nozzle valve 20. The nozzle valve 20 consists of a needle 20*b*, a rod 23, and a control piston 20*c*. The needle 20*b* is disposed slidably within the needle chamber 12*e* and has a seating edge 20*a* which is to rest on the valve seat 12*a*. The control piston 20*c* is disposed sidably within the needle chamber 11*d*. The nozzle valve 20 is urged by a coil spring 15 into constant engagement with the valve seat 12*a*.

Figure 3:
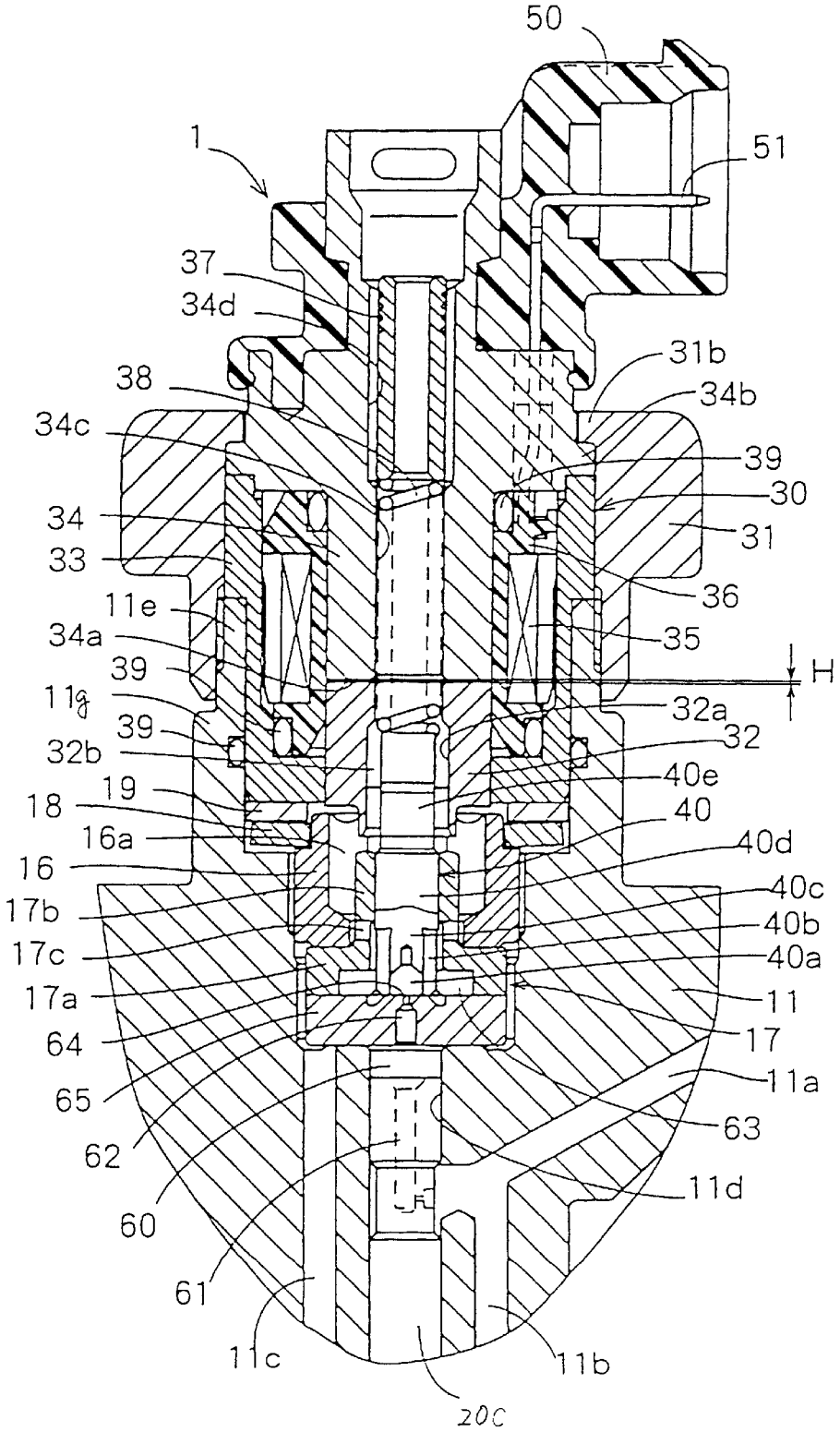
FIG. 3 is a partially enlarged view which shows a fuel jet characteristic adjusting mechanism of a fuel injector of the invention.

The housing 11 has formed therein, as shown in FIG. 3, a pressure chamber 60 which is defined by an inner wall of the needle chamber 11*d*, an end surface of the control piston 20*c*, and an end surface of a plate 65. The pressure chamber 60 communicates with an inlet orifice 61 and an outlet orifice 62. The outlet orifice 62 is greater in a fuel flow area than the inlet orifice 61. The inlet orifice 61 is formed in an end portion of the control piston 20*c* of the nozzle valve 20 and leads to the fuel inlet passage 11*a*. The high-pressure fuel is supplied to the pressure chamber 60 from the fuel inlet passage 11*a* through the inlet orifice 61. The outlet orifice 62 is formed in the plate 65 and communicates with a low-pressure valve chamber 63 through a valve hole 64. The plate 65 defines an annular gap between a side wall thereof and the inner wall of the housing 11 which leads to the leak passage 11*c*.

The valve chamber 63 is defined by an end surface of the plate 65 and an inner wall of a guide member 17 which is made of a hollow cylinder consisting of a large-diameter portion 17*a* and a small-diameter portion 17*b*. The large-diameter portion 17*a* has formed in a bottom wall thereof grooves (not shown) which define fuel paths between the bottom of the large-diameter portion 17*a* and the plate 65 establishing fluid communication between the valve chamber 63 and the leak passage 11*c* through the annular gap around the side wall of the plate 65. The small-diameter portion 17*b* has drain passages 17*c* formed in a side wall thereof. The plate 65 and the guide member 17 are retained within the housing 11 using a cylindrical screw 16. The cylindrical screw 16 defines an annular gap 16*a* between an inner wall thereof and an outer wall of the small-diameter portion 17*b* of the guide member 17.

Disposed slidably within the guide member 17 is a control valve 40 which consists of a spherical member 40*a*, a hollow cylinder 40*b*, a small-diameter portion 40*c*, a large-diameter portion 40*d*, and a pillow-like stem 40*e*. The spherical member 40*a* works to close the valve hole 64 and is joined to the small-diameter portion 40*c* through the cylinder 40*b*. The large-diameter portion 40*d* is supported slidably by the inner wall of the guide member 17. The stem 40*e* is press-fitted within a through hole 32*a* formed in an armature 32. The armature 32 and the control valve 40 are moved together in a longitudinal center line of the housing 11. The through hole 32*a* is circular, while the stem 40*e* is, for example, oval in section, so that gaps 32*b* are defined between an inner wall of the hole 32*a* and the periphery of the stem 40*e*. The gaps 32*b* communicate with the valve chamber 63 through the annular gap 16*a* and the drain passages 17*c* to define a first drain passage.

The fuel injector 1 also includes an actuator 30 retained by an inner wall of a boss 11*g* formed on the end of the housing 11. The actuator 30 is urged by a disc spring 18 through a washer 19 upward, as viewed in the drawing. The actuator 30 consists of a casing 33, a stator 34, a coil 35, and a connector 50.

The casing 33 is made of a hollow cylindrical member and disposed slidably within the boss 11*g* of the housing 11. The casing 22 has disposed therein a bobbin 36 around which the coil 35 is wound. The coil 35 is connected electrically to a terminal 51 installed in the connector 50. When the coil 35 is energized by a drive pulse signal outputted by the ECU 106, it will cause the stator 34, the casing 33, and the armature 32 to produce a magnetic circuit. The stator 34 has a spring chamber 34*c* leading to the gap 32*b*. Within the spring chamber 34*c*, a coil spring 38 is disposed. An adjusting screw 37 is screwed into the spring chamber 34*c* in engagement with an internal thread 34*d* for adjusting a valve-opening pressure, as described later in detail. The adjusting screw 37 is made of a hollow cylindrical member whose internal chamber leads to the gap 32*b* to define a second drain passage. The stator 34 also has a large-diameter chamber 70 upstream of the spring chamber 34*c* to which a return pipe 102, as shown in FIG. 1, is connected. The adjusting screw 37 has formed on an upper end thereof, as viewed in FIG. 3, a groove (not shown) extending over the diameter thereof for facilitating ease of tightening or loosening the adjusting screw 37.

An air gap-adjusting screw 31 made of a hollow cylindrical member is installed on the housing 11 in engagement with an external thread 11*e* formed on the periphery of the boss 11*g*. The air gap-adjusting screw 31 has an annular protrusion 31*b* projecting inwardly from an inner end wall thereof. The annular protrusion 31*b* is in slidable contact with an upper end surface of a flange 34*b* formed on the stator 34. Specifically, the air gap-adjusting screw 31 and the actuator 30 forms a sliding pair. The stator 34 is urged upward, as viewed in the drawing, by the disc spring 18 through the casing 33 to bring the flange 34*b* into constant engagement with the annular protrusion 31*b* and set in position thereof in a longitudinal direction of the housing 11 by the air gap-adjusting screw 31. Annular sealing members 39 are provided for sealing the actuator 30 and the injector 1.

A fuel injection operation of the fuel injector 1 will be discussed below.

The ECU 106 actuates the fuel injection pump 104 and delivers the fuel to the accumulator pipe 103. The fuel is stored in the accumulator pipe 103 at a constant high pressure level and supplied to each of the injectors 1 through the supply pipe 109.

The ECU 106 produces a control valve-actuating current as a function of an operating condition of the engine and outputs it to the coil 35 of the actuator 30 in the form of a pulse signal. When the coil 35 is energized, it will cause the stator 34 to produce an attractive force. When the sum of the attractive force and the fuel pressure within the pressure chamber 60 acting on the control valve 40 (i.e., the armature 32) exceeds the spring pressure of the spring 38, the armature 32 is attracted to the stator 34, thereby causing the control valve 40 to be lifted upward, as viewed in FIGS. 2 and 3, so that the spherical member 40*a* of the control valve 40 leaves the valve hole 64 to open the outlet orifice 62. When the outlet orifice 62 is opened, it establishes the fluid communication between the pressure chamber 60 and the valve chamber 63, thereby causing the fuel to flow from the pressure chamber 60 to the valve chamber 63. The fuel entering the valve chamber 63 is drained to the fuel tank 105, as shown in FIG. 1, through the drain passage 17*c*, the gaps 16*a* and 32*b*, the spring chamber 34*c*, the inside of the adjusting screw 37, and the return pipe 102.

When the pressure chamber 60 communicates with the valve chamber 63, it will cause the quantity of fuel flowing into the pressure chamber 60 to be greater than that flowing out of the pressure chamber 60, so that the fuel pressure within the pressure chamber 60 drops. The rate of a pressure drop in the pressure chamber 60 depends upon a difference in fuel flow area between the inlet orifice 61 and the outlet orifice 62 and the volume of the pressure chamber 60. When the fuel pressure in the pressure chamber 60 decreases, and the sum of the spring pressure of the spring 15 and the fuel pressure in the pressure chamber 60 urging the needle 20*b* in the spray hole-closing direction overcomes the fuel pressure in the fuel sump 12*c* urging the needle 20*b* in the spray hole-opening direction, it will cause the needle 20*b* to be moved away from the valve seat 12*a* to open the spray hole 12*b*, thereby producing a fuel jet.

When the coil 35 is deenergized, it will cause the attractive force to disappear from the stator 34, so that the spring pressure of the spring 38 overcomes the fuel pressure in the pressure chamber 60 to move the control valve 40 downward, thereby closing the valve hole 64 through the spherical member 40*a*. The fuel continues flowing into the pressure chamber 60 through the inlet orifice 61, so that the fuel pressure in the pressure chamber 60 is elevated. When the sum of the spring pressure of the spring 15 and the fuel pressure in the pressure chamber 60 acting on the needle 20*b* in the spray hole-closing direction overcomes the fuel pressure in the fuel sump 12*c* in the spray hole-opening direction, it will cause the needle 20*b* to move downward, as viewed in FIG. 2, so that the seating edge 20*a* of the needle 20*b* rest on the valve seat 12*a* to close the spray hole 12*b*, thereby stopping the fuel injection.

The correlation between a drive pulse signal applied to the coil 35 and the fuel injection will be described below with reference to FIG. 4.

Figure 4:
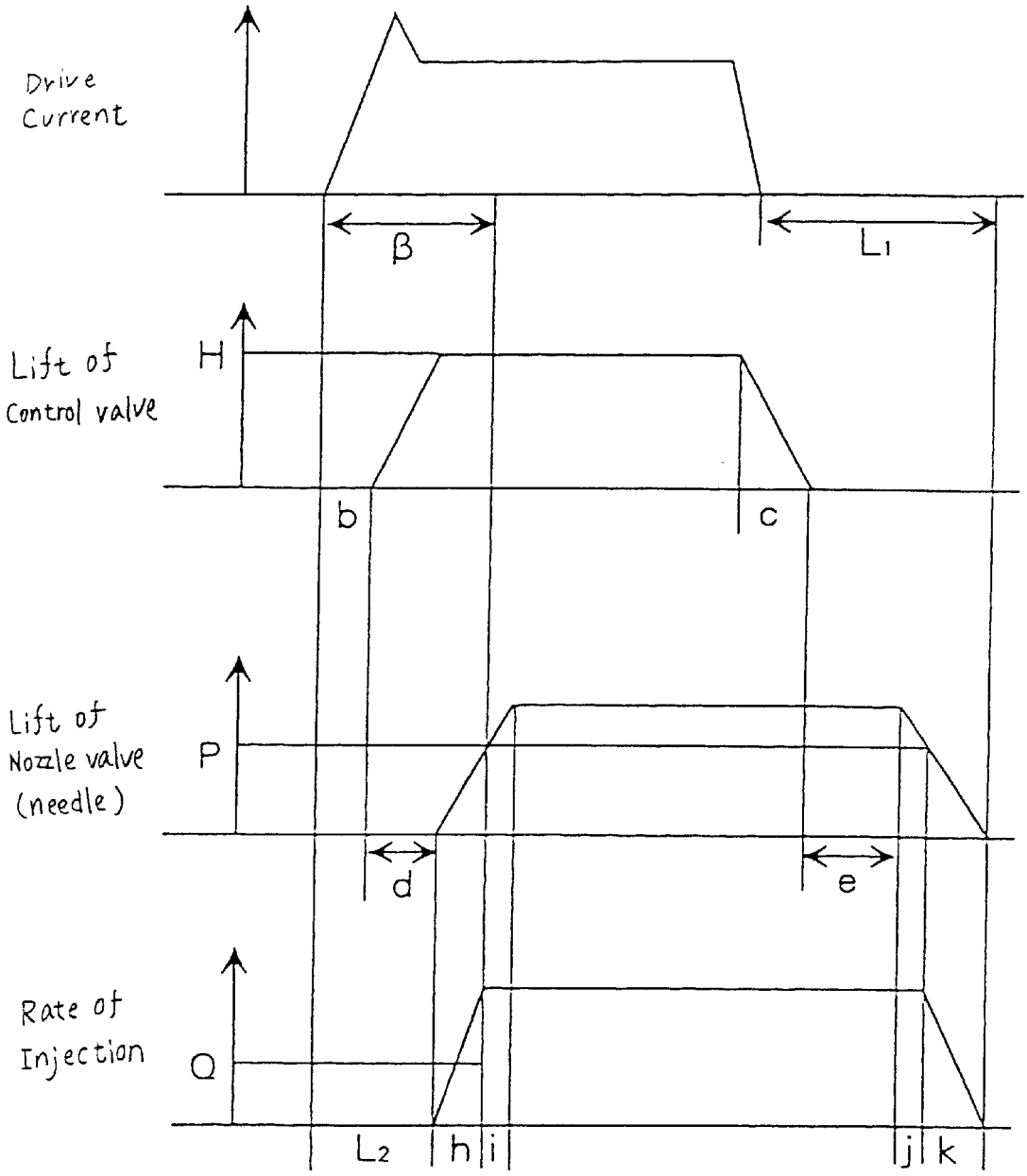
FIG. 4 is a time chart which shows the waveform of an electric current produced when a rectangular drive pulse is applied to a fuel injector, the movement of a control valve and a needle, and the rate of fuel injected.

FIG. 4 is a time chart representing the waveform of an electric current produced when a rectangular drive pulse is applied to the fuel injector 1, the movement of the control valve 40 and the nozzle valve 20 (i.e., the needle 20*b*), and the rate of fuel injected. The shown time chart is not peculiar to the fuel injectors 1 of this embodiment, but common to typical accumulator injectors for diesel engines.

Following the rise of the drive pulse signal, a time b is consumed by the stator 34 which is required to produce an attractive force for initiating a lift of the control valve 40 in the valve-opening direction against the sum of the spring pressure of the spring 38 and the fuel pressure in the pressure chamber 60. Therefore, as the spring pressure of the spring 38 is decreased, the time interval b is shortened.

When the control valve 40 opens the valve hole 64, it will cause the fuel pressure in the pressure chamber 60 to decrease at a rate which is a function of a difference between the quantity of fuel flowing out of the outlet orifice 62 and the quantity of fuel entering at the inlet orifice 61. Following the initiation of a lift of the nozzle valve 20 from the valve seat 12*a*, a time d is consumed until the fuel pressure in the pressure chamber 60 acting on the nozzle valve 20 drops below the sum of the fuel pressure in the fuel sump 112*c* and the spring pressure of the spring 15 in the spray hole-opening direction to produce a fuel jet from the spray hole 12*b*.

The sum of the times b and d indicates a time lag L2 between the rise of the drive pulse signal applied to the coil 35 of the actuator 30 and the initiation of the fuel injection which may be controlled by changing the spring pressure of the spring 38.

During a time period h required for moving the nozzle valve 20 away from the valve seat 12*a* up to a lift position P, the rate of fuel injection depends upon a minimum sectional area of a gap defined between the seating edge 21*a* and the valve seat 12*a* through which the fuel flows (which will also be referred to below as a fuel flow seat area) because it is smaller than a fuel flow area of the spray hole 12*b*. Thus, during the time period h, the rate of fuel injection increases as the nozzle valve 20 is lifted. Note that the fuel flow seat area is assumed to be equal to the fuel flow area of the spray hole 12*b* when the nozzle valve 20 reaches the lift position P.

During a time period i required for the nozzle valve 20 to move from the lift position P to a full lift position, the fuel flow area of the spray hole 12*b* is smaller than the fuel flow seat area, so that the quantity of fuel injected depends upon the fuel flow area of the spray hole 12*b*. Thus, during the time period i, the amount of lift of the nozzle valve 20 increases with time, while the rate of fuel injection is kept constant.

Upon falling of the drive pulse signal applied to the coil 35, the control valve 40 starts to move in the valve-closing direction. The control valve 40 moves a distance equivalent to an air gap H, as shown in FIG. 3, between the stator 34 and the armature 32 during a time period c required for the control valve 40 to move downward from the full lift position to a valve-closing position where the control valve 40 closes the valve hole 64. Therefore, if the spring pressure of the spring 38 is fixed, an increase in the air gap H will cause a traveling distance of the control valve 40 to increase, so that the time period c is increased. Alternatively, if the air gap H is fixed, an increase in the spring pressure of the spring 38 will cause the velocity of movement of the control valve 40 to increase, so that the time period c is decreased.

When the control valve 40 closes the valve hole 64, the fuel pressure in the pressure chamber 60 is elevated gradually by a fuel flow from the inlet orifice 61. Following the closing of the valve hole 64, a time e is consumed until the fuel pressure in the pressure chamber 60 acting on the nozzle valve 20 in the spray hole-closing direction overcomes the sum of the fuel pressure in the fuel sump 12*c* and the spring pressure of the spring 15 to initiate a downward movement of the nozzle valve 20.

During a time period j required for the nozzle valve 20 to move downward from the full lift position to the lift position P, the fuel flow area of the spray hole 12*b* is smaller than the fuel flow seat area, so that the rate of fuel injection depends upon the fuel flow area of the spray hole 12*b*. Specifically, during the time period j, the amount of lift of the nozzle valve 20 decreases with time, while the rate of fuel injection is kept constant.

During a time period k required for the nozzle valve 20 is moved downward from the lift position P and seated at the valve seat 12*a* to close the spray hole 12*b*, the fuel flow seat area is smaller than the fuel flow area of the spray hole 12*b*, so that the rate of fuel injection depends upon the fuel flow seat area. Specifically, during the time period k, the rate of fuel injection decreases as the nozzle valve 20 is moved downward.

The sum of the times c, e, j, and k indicates a time lag L1 between the falling of the drive pulse signal applied to the coil 35 of the actuator 30 and the termination of fuel injection. As the lag time L1 is increased, the rate of fuel injection is increased. The quantity of fuel injected may, thus, be controlled by adjusting the air gap H or the spring pressure of the spring 38.

The adjustment of a fuel jet characteristic of the fuel injector 1 performed prior to installation in the engine will be described below.

The adjustment of the quantity of fuel to be injected into the engine, as apparent from the above discussion, can be accomplished by controlling the fuel injection time lag L2 and/or the fuel termination time lag L1.

The control of the fuel injection time lag L2, as seen from the above discussion, can be performed by adjusting the spring pressure of the spring 38 which is accomplished by regulating the amount of insertion of the adjusting screw 37 into the spring chamber 34*c*, that is, by tightening or loosening the adjusting screw 37. Specifically, the amount of fuel to be injected into the engine can be regulated by turning the adjusting screw 37 while the fuel is delivered to the fuel injector 1 through the connector 11*f*, and the drive pulse signal is applied to the coil 35 through the terminal 51 to monitor the rate of fuel injection.

The control of the fuel termination time lag L1, as seen from the above discussion, can be achieved by adjusting the spring pressure of the spring 38 or the air gap H. The adjustment of the air gap His accomplished by turning the air gap-adjusting screw 31 to move the stator 34 against the spring pressure of the disc spring 18 urging the stator 34 upwards through the casing 33. Specifically, the amount of fuel to be injected into the engine can be regulated by turning the air gap-adjusting screw 31 while the fuel is supplied to the fuel injector 1 through the connector 11*f*, and the drive pulse signal is applied to the coil 35 through the terminal 51 to monitor the rate of fuel injection.

Specifically, the fuel injection time lag L2 can be adjusted by turning the adjusting screw 37. The quantity of fuel to be injected into the engine can be adjusted by turning the adjusting screw 37 and/or the air gap-adjusting screw 31. These adjustments, therefore, eliminate a difference in quantity of a fuel jet between the fuel injectors 1.

Figure 8:
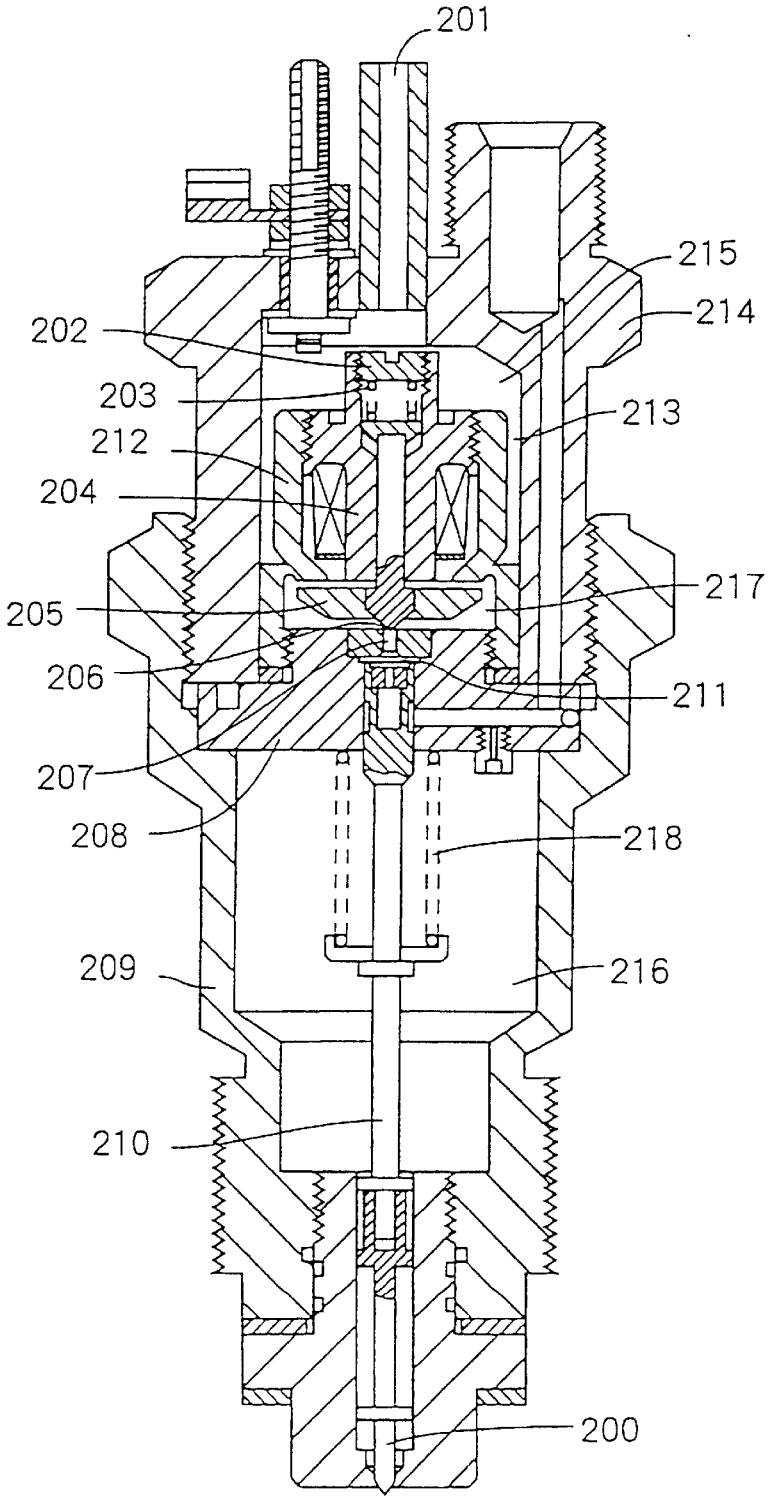
FIG. 8 PRIOR ART
FIG. 8 is a vertical sectional view which shows a conventional fuel injector.

When the control valve 40 is lifted up to open the valve hole 64, the fuel in the pressure chamber 60 flows into the valve chamber 63 and then drains into the fuel tank 105, as shown in FIG. 1, through the drain passage 17*c*, the gaps 16*a* and 32*b*, the spring chamber 34*c*, the inside of the adjusting screw 37, and the return pipe 102. Specifically, the fuel pressure in the pressure chamber 60 is released out of the fuel injector 1 through the inside of the coil 35 and the bobbin 36. Further, the housing 11, the actuator 30, and the air gap-adjusting screw 31 are arranged coaxially with each other. This allows the size of the fuel injector 1 to be decreased as compared with the conventional injector shown in FIG. 8.

After the adjustment of the fuel jet characteristic of the fuel injector 1 in the above manner, the air gap-adjusting screw 31 is preferably crimped to establish a tight connection with the boss 11*g* of the housing 11 for fixing the location of the actuator 30 relative to the housing 11 in the longitudinal direction.

Instead of the air gap-adjusting screw 31, the casing 33 may be so designed as to be screwed into the boss 11*g* together with the stator 34 to change the air gap H. In this case, the stator 34 is joined fixedly to the casing 33. Moreover, instead of the air gap-adjusting screw 31, a cylindrical member capable of being press-fitted into the boss 11*g* of the housing 11 may be used to change the air gap H. Further, instead of the adjusting screw 37, a pipe capable of being press-fitted into the spring chamber 34*c* may be used to adjust the spring pressure of the spring 38. The disc spring 18 may be replaced with a coil spring. The pressure chamber 60 leads to the fuel inlet passage 11*a* through the inlet orifice 61, but may alternatively communicate directly with the fuel inlet passage 11*a*.

The second method of adjusting the fuel jet characteristic of the fuel injector 1 will be described below.

The second method is a method of adjusting the quantity of fuel jetting out of the fuel injector 1 (also referred to below as an injection quantity) to a target range by turning the adjusting screw 37 while applying a first pulse signal having a smaller width $\alpha$ and a second pulse signal having a greater width $\gamma$ to the coil 35 of the actuator 30.

In the following discussion, a time period required for the rate of fuel injection to reach a maximum level after rise of a drive pulse signal having an infinite width applied to the coil 35 is defined as $\beta$. A maximum pressure of fuel supplied to the fuel injector 1 when used actually in the engine is defined as Pm. The pressure of liquid supplied to the fuel injector 1 for adjusting the fuel jet characteristic is defined as Pt. Further, a target injection quantity at an adjustment timing point 1 (see FIG. 7 as discussed later in detail) when the first pulse signal is applied to the coil 35 of the fuel injector 1 is defined as a first target value V1*d*. The injection quantity as measured actually at the adjustment timing point 1 is defined as V1*t*. A target injection quantity at an adjustment timing point 2 when the second pulse signal is applied to the coil 35 of the fuel injector 1 is defined as a second target value V2*d*. The injection quantity as measured at the adjustment timing point 2 is defined as V2*t*. Differences between V1*d* and V1*t* and between V2*d* and V2*t* are defined as $\delta 1t$ and $\delta 2t$, respectively. Permissible ranges of the differences $\delta 1t$ and $\delta 2t$ are defined as $\delta 1m$ (e.g., 0.5 $mm^3$/st or less) and $\delta 2m$ (e.g., 1 $mm^3$/st or less). The product of $\delta 1t$ and $\delta 2t$ is defined as PN. The sum of squares of $\delta 1t$ and $\delta 2t$ is defined as Xt. A target value of Xt is defined as Xd. A difference between Xt and Xd is defined as $\delta$Xt. A permissible difference between Xd and Xt is defined as $\delta$Xm (e.g., 1 $mm^3$/st or less).

Figure 5:
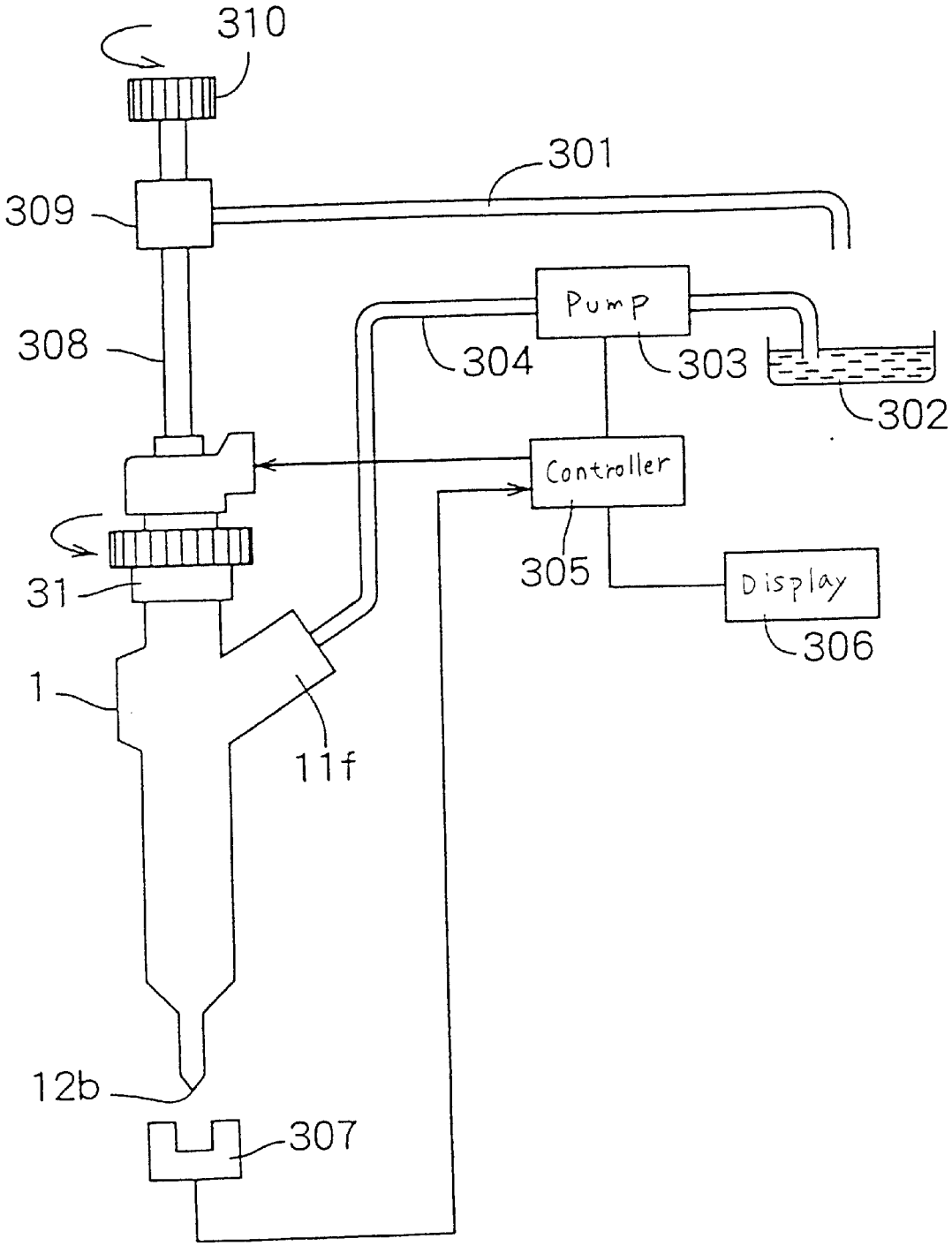
FIG. 5 is a block diagram which shows an adjustment device used to adjust a fuel jet characteristic of a fuel injector.

FIG. 5 shows an adjustment device used in this embodiment to adjust the fuel jet characteristic of the fuel injector 1.

A pump 303 is joined to the connector 11*f* of the fuel injector 1 through a test liquid supply pipe 304 to connect a tank 302 and the fuel inlet passage 11*a* of the fuel injector 1. The pump 303 is actuated by a controller 305 to supply a test liquid in the tank 302 to the fuel inlet passage 11*a* of the fuel injector 1. A measuring device 307 which is connected to the controller 305 is disposed beneath the spray hole 12*b* of the fuel injector 1. The controller 305 is electrically connected to the coil 35 of the fuel injector 1 through the terminal 51 for applying a drive pulse signal having a variable width to the coil 35. A display 306 is connected to the controller 305. The measuring device 307 has installed therein a sensor capable of measuring the start of a fuel jet from the spray hole 12*b* and the quantity of the fuel jetting out of the fuel injector 1. An adjusting pipe 308 is attached to the end of the adjusting screw 37 of the fuel injector 1 to make a fluid connection of the inside of the adjusting pipe 308 and the inside of the adjusting screw 37. The adjusting pipe 308 is so designed as to tighten or loosen the adjusting screw 37 and held rotatably by a supporting member 309. The supporting member 309 connects with the tank 302 through a return pipe 301 for draining the test liquid out of the fuel injector 1. An adjusting rod 310 with a knob is connected to the adjusting pipe 308 in alignment therewith and rotatable together with the adjusting pipe 308.

First, the controller 305 actuates the pump 303 to feed the test liquid to the fuel injector 1 at the constant pressure Pt at least greater than ½ of Pm, e.g., equal to Pm and applies the first pulse signal whose width $\alpha$ is shorter than the time period $\beta$ and the second pulse signal whose width $\gamma$ is greater than the time period $\beta$ alternately to the coil 35 to spray the test liquid from the spray hole 12*b*. The fuel delivered to the fuel injector 1 other than that discharged from the spray hole 12*b* is drained to the tank 302 through the adjusting pipe 308 and the return pipe 301.

The measuring device 307 measures the injection quantities V1*t* and V2*t* and data signals indicative thereof to the controller 305. The controller 305 determines $\delta 1t$, $\delta 2t$, PN, Xt, and $\delta$Xt using equations below and indicates them on the display 306.

$$\delta 1t = V1d - V1t$$

$$\delta 2t = V2d - V2t$$

$$PN = \delta 1t \times \delta 2t$$

$$Xt = \delta 1t^2 \times \delta 2t^2$$

$$\delta Xt = Xd - Xt$$

Figure 6:
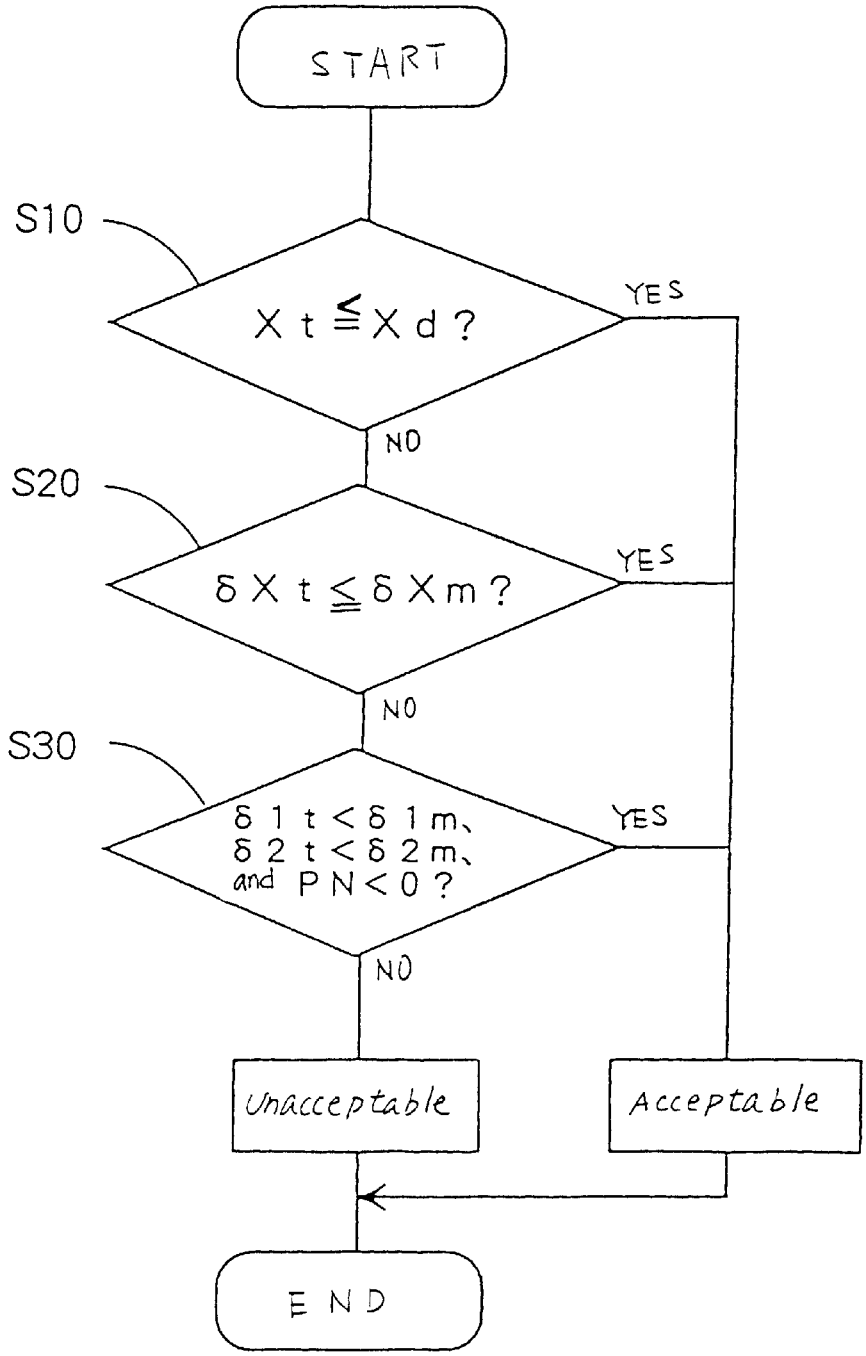
FIG. 6 is a flowchart which shows a sequence of adjustment steps performed by an operator using the adjustment device of FIG. 5.

Subsequently, an operator performs steps, as shown in FIG. 6, to adjust the quantity of test liquid jetting out of the fuel injector 1 for a given injection period to a desired one.

First, in step 10, it is determined whether Xt is smaller than or equal to Xd or not. If Xt≦Xd, it is concluded that the fuel injector 1 is a satisfactory produce. Alternatively, if Xt>Xd, the adjusting rod 310 is turned to tighten or loosen the adjusting screw 37 for bringing Xt into agreement with Xd. If Xt has reached Xd or less, it is concluded that the injection quantity of the fuel injector 1 has fallen within a target range, and the routine terminates.

If Xt does not reach Xd, the routine proceeds to step 20 wherein the adjusting rod 310 is further rotated to determine whether $\delta$Xt is smaller than or equal to $\delta$Xm or not. If a YES answer is obtained, it is concluded that the injection quantity of the fuel injector 1 has fallen within the target range, and the routine terminates. Alternatively, if a NO answer is obtained meaning that $\delta$Xt does not become smaller than $\delta$Xm, then the routine proceeds to step 30 wherein the adjusting rod 310 is further turned to determine whether conditions of $\delta 1t < \delta 1m$, $\delta 2t < \delta 2m$, and PN<0 are all met or not. If a YES answer is obtained, then it is concluded that the injection quantity of the fuel injector 1 has fallen in the target range, and the routine terminates. Alternatively, if a NO answer is obtained meaning that it is impossible to met all the conditions, it is concluded that the fuel injector 1 is an inferior product, and the routine terminates.

Turning of the adjusting screw 37, as described above, causes the spring pressure of the spring 38 to change, thereby changing the fuel injection duration. If the fuel injection duration is constant, the injection quantity increases with an increase in pressure of the test liquid supplied to the fuel injector 1. Specifically, as the pressure of the test liquid supplied to the fuel injector 1 is elevated, a change in injection quantity per unit movement of the adjusting screw 37 increases.

Therefore, in a case where the test liquid is supplied to the fuel injector 1 at the constant pressure Pt, and a drive pulse signal having a given width is applied to the coil 35 to adjust the injection quantity, the higher the pressure Pt, the greater will be the change in injection quantity per unit movement of the adjusting screw 37. A change in injection quantity will result in changes in value of $\delta 1t$, $\delta 2t$, Xt, and $\delta$Xt, so that the greater the change in injection quantity, the greater the changes in value of $\delta 1t$, $\delta 2t$, Xt, and $\delta$Xt. Therefore, the higher the pressure Pt, the greater will be the changes in value of $\delta 1t$, $\delta 2t$, Xt, and $\delta$Xt per unit movement of the adjusting screw 37.

The adjustment of the injection quantity of the fuel injector 1 in this embodiment is, as described above, accomplished by changing the spring pressure of the spring 38 using the adjustment screw 37 while supplying the test liquid to the fuel injector 1 at the same pressure as a maximum pressure of fuel supplied actually to the fuel injector 1 when installed in the engine. This, therefore, results in increased accuracy in adjusting the quantity of fuel injected actually into the engine, thus minimizing a difference in the injection quantity between the fuel injectors 1.

The fuel injector 1 is subject to a variation in maximum rate of fuel injection due to dimensional variations of the fuel inlet passage 11*a*, the fuel passage 11*b*, the fuel sump 12*c*, the spray hole 12*b*, etc. within given tolerances Therefore, even if the injection quantity of the fuel injector 1 is adjusted to a desired one by changing the spring pressure of the spring 38 using the adjusting screw 37 while applying a drive pulse signal having a preselected constant width to the coil 35, the quantity of fuel jetting out of the fuel injector 1 installed actually in the engine may undergo a variation when the width of the drive pulse signal is changed according to a required power of the engine during traveling of the vehicle. This will be discussed below in detail with reference to FIG. 7.

Figure 7:
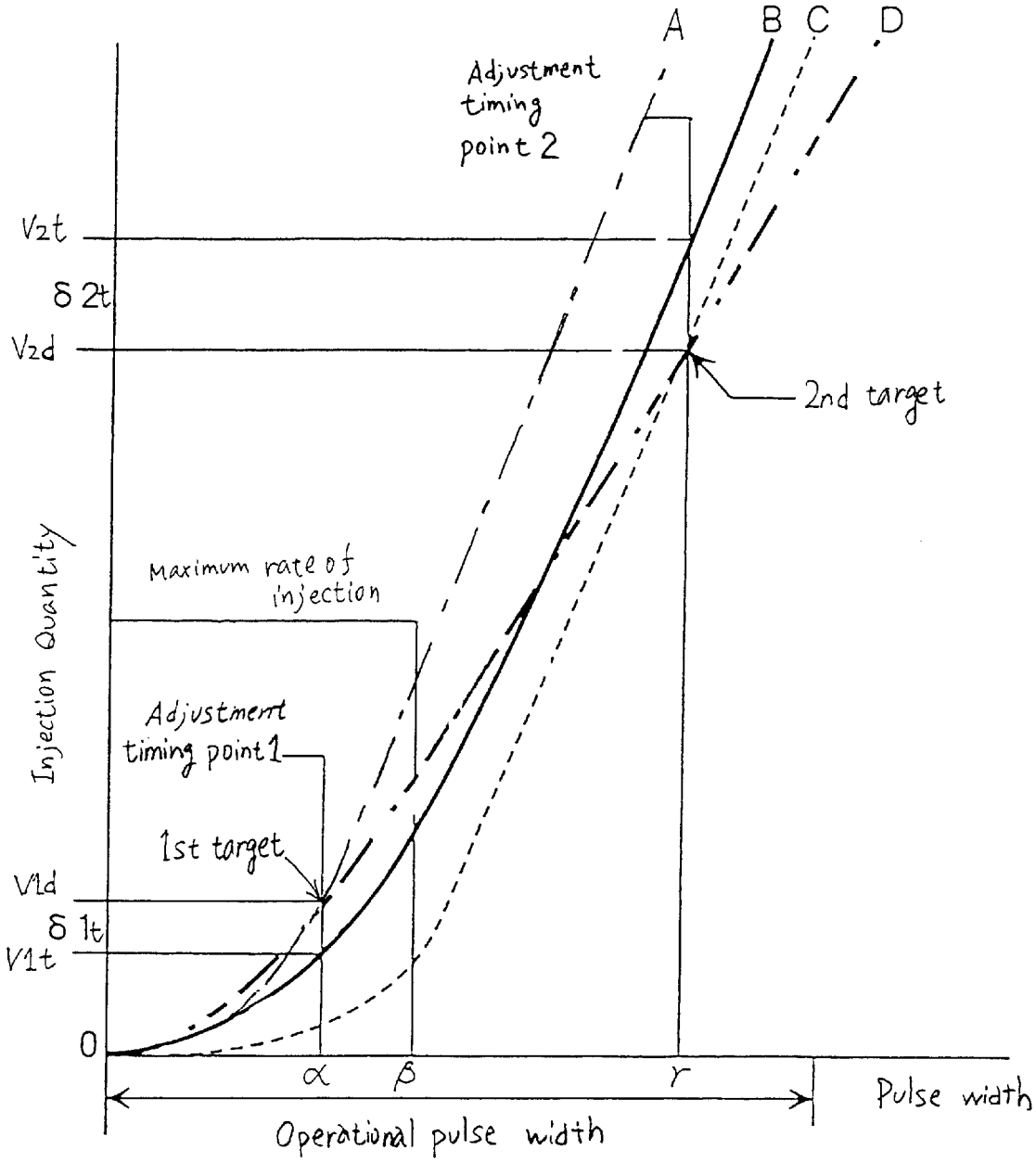
FIG. 7 is a graph which shows a relation between the rate of fuel injection and a width of a drive pulse signal applied to an actuator of a fuel injector.

In FIG. 7, the curve A indicates the injection quantity of the fuel injector 1 when the spring pressure of the spring 38 is so adjusted by the adjusting screw 37 as to have the injection quantity reach a target one determined only at the adjustment timing point 1. The curve B indicates the injection quantity of the fuel injector 1 when the fuel jet characteristic is adjusted in the second method as described above, and the injection quantity has fallen in permissible ranges at the adjustment timing points 1 and 2. The curve C indicates the injection quantity of the fuel injector 1 when the spring pressure of the spring 38 is so adjusted by the adjusting screw 37 as to have the injection quantity reach a target one determined only at the adjustment timing point 2. The curve D indicates an optimum injection quantity of the fuel injector 1 in a case where all the dimensions of the fuel inlet passage 11*a*, the fuel passage 11*b*, the fuel sump 12*c*, the spray hole 12*b*, etc. lie within tolerances of zero (0).

Each of the curves A, B, C, and D has a singular point within a range of a pulse width corresponding to the time period β required for the rate of fuel injection to reach a maximum level. Within the pulse width β, all the curves A, B, C, and D approximate to parabolas, while within a range greater than β, the curves A, B, C, and D approximate to lines tangent to the parabolas, respectively. The reason for the approximation of the curves A, B, C, and D to the parabolas within the pulse width β is that the rate of fuel injection of the fuel injector 1 is determined by the fuel flow seat area between the seating edge 20*a* and the valve seat 12*a* and thus increase as a function of a lift of the nozzle valve 20. The reason for the approximation of the curves A, B, C, and D to the tangential lines within the range greater than β is that the rate of fuel injection of the fuel injector 1 is determined by the fuel flow area of the spray hole 12*b* and thus kept constant.

In the case where the injection quantity of the fuel injector 1 is so adjusted as to reach a target one determined only at the adjustment timing point 1, the injection quantity may be shifted greatly, as indicated by the curve A, from the optimum injection quantity (i.e., the curve D) as the pulse width becomes greater than β.

In the case where the injection quantity of the fuel injector 1 is so adjusted as to reach a target one determined only at the adjustment timing point 2, the injection quantity may be shifted, as indicated by the curve C, from the optimum injection quantity over a wide range.

In the case where the injection quantity of each of a plurality of fuel injectors 1 is so adjusted in the second method as to fall in permissible ranges at the adjustment timing points 1 and 2, it is impossible to decrease both the differences δ1*t* and δ2*t* between V1*d* and V1*t* and between V2*d* and V2*t* to zero (0), as indicated by the curve B, unless all the injectors 1 are exactly identical in dimensions with each other. In the second method, as described above, the adjusting screw 37 is turned so as to minimize the sum Xt of squares of δ1*t* (=a difference between V1*d* and V1*t*) and δ2*t* (=a difference between V2*d* and V2*t*). The injection quantity of the fuel injector 1 adjusted in the second method will, thus, be closest to the optimum curve D.

Additionally, if δXt (=a difference between Xt and Xd) is not decreased below the permissible value Xm, the adjusting screw 37 is turned so as to meet the conditions of δ1*t*<δ1*m*, δ2*t*<δ2*m*, and PN<0 (see step 30 in FIG. 6). The injection quantity approximating the optimum curve D is, thus, derived between the adjustment timing points 1 and 2 because of PN (=the product of δ1*t* and δ2*t*).

The third method of adjusting the fuel jet characteristic of the fuel injector 1 will be described below.

The third method is different from the second method only in that the quantity of fuel jetting out of the fuel injector 1 is adjusted by turning the air gap-adjusting screw 31. Specifically, in steps 10, 20, and 30 in FIG. 6, the air gap-adjusting screw 31 is turned while applying the first pulse signal having a smaller width α and the second pulse signal having a greater width γ to the coil 35 of the actuator 30.

Turning of the air gap-adjusting screw 31, as described above, causes the stator 34 to be shifted in the longitudinal direction of the casing 11, so that the air gap H between the stator 34 and the armature 32 changes, thus, resulting in a change in fuel injection duration. If the fuel injection duration is constant, the injection quantity increases with an increase in pressure of the test liquid supplied to the fuel injector 1. Specifically, as the pressure of the test liquid supplied to the fuel injector 1 is elevated, a change in injection quantity per unit movement of the air gap-adjusting screw 31 increases.

Therefore, in a case where the test liquid is supplied to the fuel injector 1 at the constant pressure Pt, and a drive pulse signal having a given width is applied to the coil 35 to adjust the injection quantity, the higher the pressure Pt, the greater will be the change in injection quantity per unit movement of the air gap-adjusting screw 31. A change in injection quantity will result in changes in value of δ1*t*, δ2*t*, Xt, and δXt, so that the greater the change in injection quantity, the greater the changes in value of δ1*t*, δ2*t*, Xt, and δXt. Therefore, the higher the pressure Pt, the greater will be the changes in value of δ1*t*, δ2*t*, Xt, and δXt per unit movement of the air gap-adjusting screw 31.

The adjustment of the injection quantity of the fuel injector 1 in this embodiment is, as described above, accomplished by changing the air gap H using the air gap-adjustment screw 31 while supplying the test liquid to the fuel injector 1 at the same pressure as a maximum pressure of fuel supplied actually to the fuel injector 1 when installed in the engine. This, therefore, results in increased accuracy in adjusting the quantity of fuel injected actually into the engine, thus minimizing a difference in the injection quantity between the fuel injectors 1.

The fourth method of adjusting the fuel jet characteristic of the fuel injector 1 will be described below which is a combination of the second and third methods as described above. Specifically, this method first adjusts the fuel injection time lag L2 of the fuel injector 1 by turning the adjusting screw 37 while applying the first pulse signal having a smaller width α and the second pulse signal having a greater width γ to the coil 35 of the actuator 30 and then adjusts the quantity of fuel jetting out of the fuel injector 1 by turning the air gap-adjusting screw 31. Note that α<β<γ similar to the above embodiments.

1 Adjustment of Fuel Injection Time Lag

The adjustment of the fuel injection time lag L2 is achieved by applying either of the first and second pulse signals to the coil 35 of the actuator 30. In the fourth method as discussed below, the first pulse signal is applied to the coil 35 to control the fuel injection time lag L2.

First, the controller 305 actuates the pump 303 to feed the test liquid to the fuel injector 1 at the constant pressure Pt (<0.5 Pm) and outputs the first pulse signal to the coil 35 to spray the test liquid from the spray hole 12*b*.

Upon initiation of spraying of the test liquid from the fuel injector 1, the measuring device 307 starts to measure the injection quantity V1*t*. When detecting a liquid jet from the fuel injector 1, the measuring device 307 outputs a signal indicative thereof to the controller 305. The controller 305 then determines a time interval between the output of the first pulse signal and reception of the signal from the measuring device 307 and indicates it as the fuel injection time lag L2 on the display 306.

Subsequently, the operator turns the adjusting screw 37 through the adjusting rod 310 and the adjusting pipe 308 so that the injection time lag L2 indicated on the display 306 may fall within a target range. If the injection time lag L2 has fallen within the target range, the operator terminates the adjusting operation.

When the control valve 40 closes the valve hole 64, the pressure of the test liquid delivered from the pump 303 to the fuel injector 1 is equal to the pressure within the pressure chamber 60. A lift of the control valve 40 is initiated when the valve-opening force that is the sum of the pressure of the test liquid in the pressure chamber 60 acting on the control valve 40 and the attractive force produced by the stator 34 overcomes the spring pressure of the spring 38. If the pressure of the test liquid in the pressure chamber 60 exerted on the is low, a ratio of the spring pressure of the spring 38 to the valve-opening force will be great. Therefore, when the pressure of the test liquid supplied to the fuel injector 1 is low, the fuel injection time lag L2 will be very sensitive to a change in spring pressure of the spring 38.

Specifically, as the lower the pressure of the test liquid supplied to the fuel injector 1, the higher will be the accuracy in adjusting the fuel injection time lag L2. In the fourth method, the test liquid is, as described above, delivered to the fuel injector 1 at the constant pressure Pt lower than or equal to 0.5 Pm. (Pm is a maximum pressure of fuel to be delivered to the fuel injector 1 when installed actually in the engine), thus resulting in increased accuracy in adjusting the fuel injection lag time L2.

2 Adjustment of Quantiy of Fuel Jet

After the fuel injection lag time L2 is adjusted to within the target range, the quantity of fuel jetting out of the fuel injector 1 is adjusted in the same manner as the above described third method. Specifically, the controller 305 actuates the pump 303 to feed the test liquid to the fuel injector 1 at the constant pressure Pt at least greater than ½ of Pm, e.g., equal to Pm and applies the first pulse signal whose width $\alpha$ is shorter than the time period $\beta$ and the second pulse signal whose width $\gamma$ is greater than the time period $\beta$ alternately to the coil 35 to spray the test liquid from the spray hole 12*b*. The operator turns the air gap-adjusting screw 31 to adjust the injection quantity to within a target range according to the steps shown in FIG. 6.

The attractive force produced by the stator 34 is set much greater than the spring pressure of the spring 38 and does not impinge upon an initial action of the control valve 40 when lifted up regardless of the air gap H. Specifically, the adjustment of the injection quantity by turning the air gap-adjusting screw 31 does not change the fuel injection time lag L2.

As apparent from the above discussion, the fourth method of this embodiment first adjusts the fuel injection time lag L2 of the fuel injector 1 using the adjusting screw 37 and regulates the quantity of fuel jetting out of the fuel injector 1 using the air gap-adjusting screw 31. This, therefore, minimizes differences in the fuel injection time lag L2 and the quantity of fuel injected into the engine between the fuel injectors 1.

In the fourth method, the first pulse signal and the second pulse signal are applied to the coil 35 alternately, however, only one of them may be used if it is possible to estimate the quantity of the test liquid jetting out of the fuel injector 1 when the other pulse signal is applied to the coil 35. Even if the widths of the first and second pulse signals do not meet the condition of $\alpha<\beta<\gamma$, use of at least two pulse signals having different widths enables the injection quantity of the fuel injector 1 to be adjusted to a target range. If the widths of the first and second pulse signals meet the condition of $\alpha<\beta<\gamma$, it is possible to minimize a difference in injection quantity between the fuel injectors 1 all over an effective pulse width range. If $\beta<\gamma<\beta$, it is possible to minimize the difference in injection quantity between the fuel injectors 1 in a low engine speed range. If $\beta<\alpha<\gamma$, it is possible to minimize the difference in injection quantity between the fuel injectors 1 in a high engine speed range. Further, the adjustment of the fuel injection time lag L2 and the injection quantity may alternatively be performed by turning the air gap-adjusting screw 31 and the adjusting rod 310 using a step motor under automatic control of the controller 305 such as feedback control.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. A fuel injector comprising:

a nozzle having formed therein a spray hole from which fuel is sprayed;

a nozzle valve selectively opening and closing the spray hole;

an injector body supporting therein said nozzle valve slidably, said injector body having formed therein a fuel sump supplied with the fuel from an inlet formed in said injector body to produce fuel pressure urging said nozzle valve in a spray hole-opening direction, a pressure chamber supplied with the fuel from the inlet to produce fuel pressure urging said nozzle valve in a spray hole-closing direction, and a valve hole establishing fluid communication between the pressure chamber and a drain port formed in said injector body;

a control valve selectively opening and closing the valve hole formed in said injector body;

a first urging mechanism urging said control valve in a valve hole-closing direction for closing the valve hole to block the fluid communication between the pressure chamber and the drain port;

a control valve moving mechanism made up of a stationary portion and a movable portion, the stationary portion including a stator and a coil, the movable portion including an armature which is connected fixedly to said control valve and spaced from the stator through a given air gap, the coil being energized electrically to produce an attractive force through the stator for attracting the armature to move said control valve in a valve hole-opening direction, thereby opening the valve hole to establish the fluid communication between the pressure chamber and the drain port;

a second urging mechanism urging the stationary portion of said control valve moving mechanism in a first direction identical with the valve hole-opening direction; and an air gap adjusting member disposed around the stationary portion of said control valve moving mechanism in engagement with said injector body so as to urge the stationary portion of said control valve moving mechanism in a second direction opposite the first direction against an urging pressure produced by said second urging mechanism to keep the air gap between the stator and the armature, said air gap adjusting member being designed to be movable selectively in said first direction and second direction for changing the air gap.

2. A fuel injector as set forth in claim 1, wherein said air gap adjusting mechanism is connected to said injector body in a screw fashion.

3. A fuel injector as set forth in claim 2, wherein said air gap adjusting mechanism has formed therein an internal thread engaging an outer thread formed on an end portion of said injector body and forms a sliding pair with said control pair moving mechanism.

4. A fuel injector as set forth in claim 1, wherein said air gap adjusting mechanism is made of a hollow member fitted on said injector body.

5. A fuel injector as set forth in claim 1, wherein said second urging mechanism is implemented by a disc spring disposed within said injector body.

6. A fuel injector comprising:

a nozzle having formed therein a spray hole from which fuel is sprayed;

a nozzle valve selectively opening and closing the spray hole;

an injector body supporting therein said nozzle valve slidably, said injector body having formed therein a fuel sump supplied with the fuel from an inlet formed in said injector body to produce fuel pressure urging said nozzle valve in a spray hole-opening direction, a pressure chamber supplied with the fuel from the inlet to produce fuel pressure urging said nozzle valve in a spray hole-closing direction, and a valve hole for establishing fluid communication between the pressure chamber and a drain port formed in said injector body;

a valve chamber formed in said injector body downstream of the valve hole;

a control valve movable within said valve chamber to selectively open and close the valve hole formed in said injector body, when leaving the valve hole, said control valve defining in said valve chamber a first drain passage communicating with the pressure chamber through the valve hole;

an urging mechanism disposed within an urging mechanism mount chamber formed in said injector body leading to the first drain passage, said urging mechanism working to produce an urging pressure which urges said control valve in a valve hole-closing direction for closing the valve hole to block the fluid communication between the pressure chamber and the valve chamber;

a control valve moving mechanism made up of a stationary portion and a movable portion, the stationary portion including a stator and a coil, the movable portion including an armature which is connected fixedly to said control valve, the coil being energized electrically to produce an attractive force through the stator for attracting the armature to move said control valve in a valve hole-opening direction against the urging pressure produced by said urging mechanism, thereby opening the valve hole to establish the fluid communication between the pressure chamber and the first drain passage; and an urging pressure adjusting mechanism disposed within said injector body in contact with said urging mechanism, said urging pressure adjusting mechanism being so designed as to be movable in engagement with an inner wall of the urging mechanism mount chamber for changing the urging pressure produced by said urging mechanism, said urging pressure adjusting mechanism having formed therein a second drain passage communicating between the first drain passage and the drain port through the urging mechanism mount chamber.

7. A fuel injector as set forth in claim 6, wherein said urging pressure adjusting mechanism engages the inner wall of the urging mechanism mount chamber in a screw fashion.

8. A fuel injector as set forth in claim 6, wherein said urging pressure adjusting mechanism is press-fitted within the urging mechanism mount chamber.

9. A fuel injector as set forth in claim 6, further comprising:

a second urging mechanism urging the stationary portion of said control valve moving mechanism in a first direction identical with the valve hole-opening direction; and an air gap adjusting member disposed around the stationary portion of said control valve moving mechanism in engagement with said injector body so as to urge the stationary portion of said control valve moving mechanism in a second direction opposite the first direction against an urging pressure produced by said second urging mechanism to keep an air gap between the stator and the armature, said air gap adjusting member being designed to be movable selectively in said first direction and second direction for changing the air gap.

10. A fuel injector as set forth in claim 9, wherein said air gap adjusting mechanism is connected to said injector body in a screw fashion.

11. A fuel injector as set forth in claim 10, wherein said air gap adjusting mechanism has formed therein an internal thread engaging an outer thread formed on an end portion of said injector body and forms a sliding pair with said control pair moving mechanism.

12. A fuel injector as set forth in claim 9, wherein said air gap adjusting mechanism is made of a hollow member fitted on said injector body.

13. A fuel injector as set forth in claim 9, wherein said second urging mechanism is implemented by a disc spring disposed within said injector body.

14. A method of adjusting a fuel injection characteristic of a fuel injector which is designed to inject fuel into an engine and which includes:

(a) a nozzle having formed therein a spray hole from which fuel is sprayed;

(b) a nozzle valve selectively opening and closing the spray hole;

(c) an injector body supporting therein said nozzle valve slidably, said injector body having formed therein a fuel sump supplied with the fuel from an inlet formed in said injector body to produce fuel pressure urging said nozzle valve in a spray hole-opening direction, a pressure chamber supplied with the fuel from the inlet to produce fuel pressure urging said nozzle valve in a spray hole-closing direction, and a valve hole establishing fluid communication between the pressure chamber and a drain port formed in said injector body;

(d) a control valve selectively opening and closing the valve hole formed in said injector body; and (e) a control valve moving mechanism made up of a stationary portion and a movable portion, the stationary portion including a stator and a coil wound around the stator, the movable portion including an armature which is connected fixedly to said control valve and spaced from the stator through a given air gap, the coil being energized electrically to produce an attractive force through the stator for attracting the armature to move said control valve in a valve hole-opening direction, thereby opening the valve hole to establish the fluid communication between the pressure chamber and the drain port so that the fuel pressure in the pressure chamber is decreased to move said nozzle valve so as to open the spray hole, said method comprising the steps of:

supplying a test liquid to said fuel injector from the inlet at a given pressure level higher than half a maximum pressure of the fuel which is supplied to the fuel sump and the pressure chamber when the fuel injector is actually used to inject the fuel into the engine;

applying a drive pulse signal to the coil of said control valve moving mechanism to energize the coil for spraying the test liquid from the spray hole; and changing the air gap between the stator and the armature to adjust a quantity of the test liquid sprayed from the spray hole to a target one.

15. A method as set forth in claim 14, wherein said fuel injector further comprises a first urging mechanism urging said control valve in a valve hole-closing direction for closing the valve hole to block the fluid communication between the pressure chamber and the drain port; a second urging mechanism urging the stationary portion of said control valve moving mechanism in a first direction identical with the valve hole-opening direction, and an air gap adjusting member disposed around the stationary portion of said control valve moving mechanism in engagement with said injector body so as to urge the stationary portion of said control valve moving mechanism in a second direction opposite the first direction against an urging pressure produced by said second urging mechanism to keep the air gap between the stator and the armature, said air gap adjusting member being designed to be movable selectively in said first direction and second direction for changing the air gap, and wherein said air gap changing step moves said air gap adjusting mechanism to change the air gap between the stator and the armature to adjust the quantity of the test liquid sprayed from the spray hole to the target one.

16. A method as set forth in claim 14, wherein said drive pulse applying step applies a first drive pulse signal and a second drive pulse signal having a width different from that of the first drive pulse signal in sequence to the coil of said control valve moving mechanism to energize the coil during said air gap changing step.

17. A method as set forth in claim 16, wherein the width of the first drive pulse signal is longer than that required to move said nozzle valve until a maximum rate of a jet of the test liquid from the spray hole is reached.

18. A method as set forth in claim 16, wherein if target quantities of the test liquid sprayed from the spray hole when the first and second drive pulse signals are applied to the coil of said control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\beta 2$, said air gap changing step changes the air gap so as to meet at least one of a condition of $\delta 1^2+\delta 2^2 \leqq K1$ and a condition of $\delta 1 \times \delta 2<0$, $\delta 1 \leqq K2$, and $\delta 2 \leqq K3$ where K1, K2, and K3 are preselected target values, respectively.

19. A method of adjusting a fuel injection characteristic of a fuel injector which is designed to inject fuel into an engine and which includes:

(f) a nozzle having formed therein a spray hole from which fuel is sprayed;

(g) a nozzle valve selectively opening and closing the spray hole;

(h) an injector body supporting therein said nozzle valve slidably, said injector body having formed therein a fuel sump supplied with the fuel from an inlet formed in said injector body to produce fuel pressure urging said nozzle valve in a spray hole-opening direction, a pressure chamber supplied with the fuel from the inlet to produce fuel pressure urging said nozzle valve in a spray hole-closing direction, and a valve hole establishing fluid communication between the pressure chamber and a drain port formed in said injector body;

(i) a control valve selectively opening and closing the valve hole formed in said injector body;

(j) an urging mechanism disposed within an urging mechanism mount chamber formed in said injector body, said urging mechanism working to produce an urging pressure which urges said control valve in a valve hole-closing direction for closing the valve hole to block the fluid communication between the pressure chamber and the drain port; and (k) a control valve moving mechanism made up of a stationary portion and a movable portion, the stationary portion including a stator and a coil wound around the stator, the movable portion including an armature which is connected fixedly to said control valve, the coil being energized electrically to produce an attractive force through the stator for attracting the armature to move said control valve in a valve hole-opening direction, thereby opening the valve hole to establish the fluid communication between the pressure chamber and the drain port so that the fuel pressure in the pressure chamber is decreased to move said nozzle valve so as to open the spray hole, said method comprising the steps of:

supplying a test liquid to said fuel injector from the inlet at a given pressure level higher than half a maximum pressure of the fuel which is supplied to the pressure chamber when the fuel injector is actually used to inject the fuel into the engine;

applying a drive pulse signal to the coil of said control valve moving mechanism to energize the coil for spraying the test liquid from the spray hole; and changing the urging pressure produced by said urging mechanism to adjust a quantity of the test liquid sprayed from the spray hole to a target one.

20. A method as set forth in claim 19, further comprising an urging pressure adjusting mechanism disposed within said injector body in contact with said urging mechanism, said urging pressure adjusting mechanism being so designed as to be movable in engagement with an inner wall of the urging mechanism mount chamber for changing the urging pressure produced by said urging mechanism, said urging pressure adjusting mechanism having formed therein a second drain passage communicating between a first drain passage communicating with the pressure chamber through the valve hole and the drain port through the urging mechanism mount chamber, and wherein said urging pressure changing step moves said urging pressure adjusting mechanism to shift said urging mechanism for adjusting the quantity of the test liquid sprayed from the spray hole to the target one.

21. A method as set forth in claim 20, wherein said drive pulse applying step applies a first drive pulse signal and a second drive pulse signal having a width different from that of the first drive pulse signal in sequence to the coil of said control valve moving mechanism to energize the coil during said air gap changing step.

22. A method as set forth in claim 21, wherein the width of the first drive pulse signal is longer than that required to move said nozzle valve until a maximum rate of a jet of the test liquid from the spray hole is reached.

23. A method as set forth in claim 21, wherein if target quantities of the test liquid sprayed from the spray hole when the first and second drive pulse signals are applied to the coil of said control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\delta 2$, said air gap changing step changes the air gap so as to meet at least one of a condition of $\delta 1^2+\delta 2^2 \leqq K1$ and a condition of $\delta 1 \times \delta 2 \leqq 0$, $\delta 1 \leqq K2$, and $\delta 2 \leqq K3$ where K1, K2, and K3 are preselected target values, respectively.

24. A method of adjusting a fuel injection characteristic of a fuel injector which is designed to inject fuel into an engine and which includes:

(l) a nozzle having formed therein a spray hole from which fuel is sprayed;

(m) a nozzle valve selectively opening and closing the spray hole;

(n) an injector body supporting therein said nozzle valve slidably, said injector body having formed therein a fuel sump supplied with the fuel from an inlet formed in said injector body to produce fuel pressure urging said nozzle valve in a spray hole-opening direction, a pressure chamber supplied with the fuel from the inlet to produce fuel pressure urging said nozzle valve in a spray hole-closing direction, and a valve hole establishing fluid communication between the pressure chamber and a drain port formed in said injector body;

(o) a control valve selectively opening and closing the valve hole formed in said injector body;

(p) an urging mechanism disposed within an urging mechanism mount chamber formed in said injector body, said urging mechanism working to produce an urging pressure which urges said control valve in a valve hole-closing direction for closing the valve hole to block the fluid communication between the pressure chamber and the drain port; and (q) a control valve moving mechanism made up of a stationary portion and a movable portion, the stationary portion including a stator and a coil wound around the stator, the movable portion including an armature which is connected fixedly to said control valve and spaced from the stator through an air gap, the coil being energized electrically to produce an attractive force through the stator for attracting the armature to move said control valve in a valve hole-opening direction, thereby opening the valve hole to establish the fluid communication between the pressure chamber and the drain port so that the fuel pressure in the pressure chamber is decreased to move said nozzle valve so as to open the spray hole, said method comprising:

a first step of changing the urging pressure produced by said urging mechanism while supplying a test liquid to said fuel injector from the inlet and applying a drive pulse signal to the coil of said control valve moving mechanism to energize the coil for spraying the test liquid from the spray hole so as to have an injection lag time fall in a target range; and a second step of changing the air gap between the stator and the armature while supplying a test liquid to said fuel injector from the inlet and applying a drive pulse signal to the coil of said control valve moving mechanism to energize the coil for spraying the test liquid from the spray hole so as to have a quantity of the test liquid sprayed from the spray hole fall in a target range.

25. A method as set forth in claim 24, wherein the test liquid is supplied at a given pressure level lower than half a maximum pressure of the fuel which is supplied to the pressure chamber when the fuel injector is actually used to inject the fuel into the engine in the first step.

26. A method as set forth in claim 24, wherein the test liquid is supplied at a given pressure level higher than half a maximum pressure of the fuel which is supplied to the pressure chamber when the fuel injector is actually used to inject the fuel into the engine in the second step.

27. A method as set forth in claim 24, wherein the second step applies first and second drive pulse signal having different widths alternately to the coil of said control valve moving mechanism.

28. A method as set forth in claim 27, wherein in the second step, at least one of the first and second drive pulse signals has the width greater than a width required for moving said nozzle valve up to a level where a maximum rate of spraying of the test liquid from the spray hole is reached.

29. A method as set forth in claim 27, wherein if target quantities of the test liquid sprayed from the spray hole when the first and second drive pulse signals are applied to the coil of said control valve moving mechanism are defined as a first and a second target value, respectively, a difference between a quantity of the test liquid sprayed from the spray hole when the first drive pulse signal is applied to the coil and the first target value is defined as $\delta 1$, a difference between a quantity of the test liquid sprayed from the spray hole when the second drive pulse signal is applied to the coil and the second target value is defined as $\delta 2$, said air gap changing step changes the air gap so as to meet at least one of a condition of $\delta 1^2+\delta 2^2 \leqq K1$ and a condition of $\delta 1 \times \delta 2 < 0$, $\delta 1 \leqq K2$, and $\delta 2 \leqq K3$ where K1, K2, and K3 are preselected target values, respectively.

* * * * *